US010167099B2

(12) United States Patent
Hutter et al.

(10) Patent No.: US 10,167,099 B2
(45) Date of Patent: Jan. 1, 2019

(54) APPARATUS AND METHOD FOR EXPANDING AND ERECTING COLLAPSED OR FOLDED CARDBOARD PACKAGINGS TO STANDING ARRANGED COMPARTMENTS AND/OR OUTER PACKAGINGS

(71) Applicant: KRONES Aktiengesellschaft, Neutraubling (DE)

(72) Inventors: Alban Hutter, Reit im Winkl (DE); Wolfgang Fechter, Rosenheim (DE); Jens Losert, Reit im Winkl (DE)

(73) Assignee: Krones Aktiengesellschaft, Neutraubling (DE)

( * ) Notice: Subject to any disclaimer, the term of this patent is extended or adjusted under 35 U.S.C. 154(b) by 294 days.

(21) Appl. No.: 14/885,415

(22) Filed: Oct. 16, 2015

(65) Prior Publication Data

US 2016/0107408 A1 Apr. 21, 2016

(30) Foreign Application Priority Data

Oct. 20, 2014 (DE) ..... 10 2014 221 221

(51) Int. Cl.
*B31B 1/76* (2006.01)
*B31B 1/78* (2006.01)
(Continued)

(52) U.S. Cl.
CPC ..... *B65B 43/305* (2013.01); *B65B 43/265* (2013.01); *B31B 50/80* (2017.08); *B65B 43/165* (2013.01); *B65B 43/185* (2013.01)

(58) Field of Classification Search
CPC ..... B31B 2203/003; B31B 2201/287; B31B 2201/289; B31B 1/80; B31B 2120/00;
(Continued)

(56) References Cited

U.S. PATENT DOCUMENTS 3,142,232 A * 7/1964 Pierce, Jr. ..... B65B 43/305 493/310
3,323,283 A * 6/1967 Johnson, Jr. ..... B65B 43/54 414/736
(Continued)

FOREIGN PATENT DOCUMENTS

AU 8337775 1/1977
CN 202357525 8/2012
(Continued)

OTHER PUBLICATIONS

European Patent Application Extended Search Report—EP 15 18 9569—dated Feb. 11, 2016.
German Patent Application Search Report—DE 10 2014 221 221. 9—dated May 21, 2015.
Chinese Patent Application—First Office Action dated Jul. 18, 2017.

*Primary Examiner* — Andrew M Tecco
*Assistant Examiner* — Eyamindae Jallow
(74) *Attorney, Agent, or Firm* — Simmons Perrine Moyer Bergman PLC

(57) ABSTRACT

The present invention includes an apparatus (01) and a method for expanding and erecting collapsed or folded cardboard packagings (02) to a standing position. The method includes holding the topmost cardboard packaging (02), coming from above, at its top flat side (23) of a cardboard packaging wall (22) and removing it from a stack (41) of flatly collapsed cardboard packagings (02). Subsequently also holding the cardboard packaging (02), at its bottom flat side (24) from below, and increasing the vertical distance between the top flat side (23), and the bottom flat side (24), by oppositely pulling so far until the cardboard packaging (02) has been expanded. Then releasing the top flat side (23) of the cardboard packaging (02), and rotating the lying, expanded set of cardboard packaging (02) still being held at its bottom flat side (24), where the rotating is
(Continued)

about a horizontal pivoting axis (13). The bottom flat side (24) is subsequently also released to achieve an expanded and now erected set of compartments and/or the outer packagings (03). The apparatus (01) comprises a cardboard packaging supply (04) comprising at least one stack (41) of flatly collapsed cardboard packagings (02) arranged lying on top of each other, an erecting device (05) arranged next to the cardboard packaging supply (04) as seen in the direction of a horizontal axis (11), and a gripping device (06) for simultaneously seizing respectively one topmost cardboard packaging (02) from each stack (41) of the cardboard packaging supply (04).

15 Claims, 18 Drawing Sheets

(51) Int. Cl.

| | |
|---|---|
| ***B31B 1/80*** | (2006.01) |
| ***B65B 43/30*** | (2006.01) |
| ***B65B 43/26*** | (2006.01) |
| *B65B 43/16* | (2006.01) |
| *B65B 43/18* | (2006.01) |
| *B31B 50/80* | (2017.01) |

(58) Field of Classification Search

CPC ..... B31B 2120/30; B31B 2120/404; B31B 2150/001; B65B 43/28; B65B 43/46; B65B 43/265; B65B 43/185; B65B 43/305

USPC ..... 493/313, 309, 311, 314, 315, 318; 53/381.3, 382.1, 386.1

See application file for complete search history.

(56) References Cited

U.S. PATENT DOCUMENTS

| | | | | |
|---|---|---|---|---|
| 3,724,185 | A * | 4/1973 | Berney | B65B 43/285 53/249 |
| 4,201,118 | A * | 5/1980 | Calvert | B65B 43/305 271/132 |
| 4,332,123 | A | 6/1982 | Calvert | |
| 4,662,150 | A * | 5/1987 | Johnson | B65B 43/265 493/313 |
| 5,531,661 | A * | 7/1996 | Moncrief | B65B 43/265 493/313 |
| 5,536,231 | A * | 7/1996 | Nilsson | B31B 50/00 493/312 |
| 6,915,622 | B2 * | 7/2005 | Spatafora | B65B 5/06 493/313 |
| 7,243,481 | B2 * | 7/2007 | Draghetti | B65B 43/265 493/313 |
| 8,075,467 | B2 * | 12/2011 | Monti | B65B 43/28 493/177 |
| 9,027,315 | B2 * | 5/2015 | Tsutsumi | B65B 43/305 53/381.1 |
| 2014/0260119 | A1 | 9/2014 | Baltes et al. | |
| 2015/0087491 | A1 | 3/2015 | Langen | |

FOREIGN PATENT DOCUMENTS

| | | |
|---|---|---|
| EP | 2108505 | 10/2009 |
| JP | 2001088809 | 4/2001 |
| WO | 2014125627 | 8/2014 |

* cited by examiner

APPARATUS AND METHOD FOR EXPANDING AND ERECTING COLLAPSED OR FOLDED CARDBOARD PACKAGINGS TO STANDING ARRANGED COMPARTMENTS AND/OR OUTER PACKAGINGS

PRIORITY CLAIM

The present application claims priority to German Application DE 10 2014 221 221.9, file Oct. 20, 2014, which is incorporated by reference.

FIELD OF THE INVENTION

The present invention relates to an apparatus for expanding and erecting collapsed or folded cardboard packagings to standing compartments and/or outer packagings as well as to a method for erecting cardboard packagings to standing compartments and/or outer packagings.

BACKGROUND OF THE INVENTION

The handling of articles frequently involves providing individual or a plurality of articles with an outer packaging.

In the case of individual articles, this is carried out for their improved protection and/or for their improved sales presentation.

In the case of a plurality of articles, a bundle of a plurality of articles is additionally achieved by the outer packaging.

Bundles represent an effective way of enabling simultaneous handling of a plurality of articles, for instance, for facilitating the transport of a plurality of articles at the same time. For many articles, such as beverage containers, for example, bundles of a plurality of articles held together thus represent the most frequent type of sales units.

The articles can be, for instance, objects, such as, for example, packaged or unpackaged objects, containers, such as beverage bottles or cans, or in themselves bundles, in turn, of a plurality of objects, in which the objects of a bundle can be held together, for instance, by means of an embracing around the periphery of a group of objects, such as, for instance, a strapping, an outer packaging, such as a wrapping, a shrink tube, or a cardboard packaging or a carrying rack, such as a beverage crate, to name but a few conceivable embodiments.

Among others, folded boxes are used as outer packagings respectively accommodating one or more articles, because these folded boxes offer a high, and, as the case may be, additional protection for the articles accommodated therein, because they are in addition stackable together with the articles accommodated therein, and because they moreover enable identifying the articles accommodated therein by means of information printed or glued onto their outside. They can further serve as advertising media by the corresponding information on their outside.

Folded box are industrially prefabricated, mostly cuboid-shaped containers having been collapsed or folded to particularly small dimensions or pack sizes, which are space-savingly transported and stored in a folded state until they are used, in order to be easily unfolded by hand or machine, when they are needed, to form an outer packaging, as this is known from the folded boxes used for postal packages, for instance. In a collapsed state, they require little space for their transport and storage.

Outer packagings formed by containers executed as folded boxes, for instance, can be designed with or without compartments, also termed so-called baskets, arranged or arrangeable therein for separating and/or keeping apart individual articles from each other.

So-called interior fittings to be arranged or being arranged in an outer packaging, which interior fittings can consist, for instance, of dividers slotted into each other and/or connected with each other, for instance, by bending edges and/or adhesive joints, are termed compartments.

The dividers can consist of cardboard and/or paperboard or plastics, for instance. For instance, corrugated cardboard can be used for the dividers to protect sensitive articles. The dividers are and/or are to be connected with each other by bending edges and/or adhesive joints and/or slots in the dividers such that compartments are produced with, for example, a rectangular or a triangular or a polyangular base, provided for respectively one or more articles, which are fastened against shifting in the compartments.

To summarize, compartments assign fixed positions to the articles within the outer packagings and thus protect them, during the further transport and/or during the storage of the outer packagings accommodating these articles until the articles are withdrawn and consumed, for instance, from colliding with each other and rubbing against each other, which otherwise would lead to a negative impression of the quality by scuffing, for instance, of information applied onto the articles in the form of labels, for example, and/or by the articles damaging each other.

So-called blind compartments or blind cells can be realized at the outer edge of a set of compartments, which can be formed, for example, to be too small for the reception of articles. Blind compartments or blind cells at the periphery of a set of compartments inserted into an outer packaging or arranged in an outer packaging afford a further protection of articles accommodated in the outer packaging, for example in the instance of mechanical stress and/or deformation of outer packagings accommodating articles.

In analogy to the supply of folded boxes as outer packagings, compartments to be inserted into outer packagings are preferentially prefabricated and collapsed or folded to particularly small dimensions or pack sizes so that they can be space-savingly transported and stored in a folded state until they are used, in order to be easily unfolded by hand or machine when they are needed.

Outer packagings with compartments already arranged therein are moreover known. These can be designed as folded boxes with interior fittings arranged therein, which are also transported and stored in a collapsed or folded state, and which are easily unfolded by hand or machine when they are needed.

Representatively for the described outer packagings designed as unfoldable or erectable folded boxes to be easily unfolded by hand or machine when they are needed as well as foldable and unfoldable compartments just as well as outer packagings designed as folded boxes with compartments arranged therein, the term compartments and/or outer packagings will be used, which comprises the three different design variants, unless something else, for instance, only one of the design variants, is mentioned.

Compartments and/or outer packagings are preferentially produced from single- or multi-part cardboard packagings of stabilized paper, such as cardboard and/or paperboard, for example. There are cardboard packagings in different thicknesses and sizes for all types of compartments and/or outer packagings. For the protection of sensitive articles, corrugated cardboard can be used, for example.

Folded or collapsed cardboard packagings, which are unfoldable or expandable to form compartments and/or outer packagings, have cardboard packaging walls, which are interconnected with each other by bending edges and/or adhesive joints and/or slot-in connections, and which can be cut out or punched out, for instance, from sheet-formed material. In a collapsed state, at least two cardboard packaging walls connected with each other form a top and a bottom flat side, respectively, of a flatly collapsed cardboard packaging.

A collapsed cardboard packaging can be unfolded to form a set of compartments and/or an outer packaging, for instance, by pressure onto the sides of the collapsed cardboard packaging. It is just as well possible to hold the collapsed cardboard packaging at the surfaces of one cardboard packaging wall of its top and bottom flat sides, respectively, by means of suction cups, for instance, and to expand it by increasing the distance between the surfaces of the cardboard packaging walls, which distance is initially limited to the thickness dimension of the collapsed cardboard packaging. By the cardboard packaging walls being interconnected with each other, cardboard packaging walls of the cardboard packaging are also unfolded or expanded, which are arranged within the space spread out by the cardboard packaging walls of the top and bottom flat sides.

Combinations of unfolding by lateral pressure and expanding are also possible.

In the instance of an outer packaging designed as a folded box, unfolding or expanding leads to creating an interior space, and in the instance of a set of compartments that is foldable and unfoldable or in the instance of an outer packaging designed as a folded box with compartments already arranged therein, unfolding or expanding leads to creating an interior space for each cell of the compartment, which interior space is accessible by an access opening, or, as the case may be, by respectively one access opening each, spreading open a plane running normal to the cardboard packaging walls, through which access opening articles can be introduced into the respective interior space.

In handling articles, for instance, in food technology and/or beverage technology and/or packaging technology and/or in the food industry and/or beverage industry and/or packaging industry, pacing, i.e. being able to handle as many articles as possible within an as short as possible time span, represents a significant cost factor. The faster the pacing, the higher is the article throughput, and the better is thus the utilization of the machines, facilities, and devices intended for this purpose. Pacing can thus be described as the ratio of the number of articles to the period of time within which this number of articles is handled.

In order to be able to achieve high pacings, fully automatic apparatuses, also called unfolding machines or erecting machines or, termed for short unfolders or erectors, are used in the packaging technology and in the packaging industry for unfolding and/or expanding cardboard packagings to compartments and/or outer packagings, which unfolders or erectors, in connection with the staging of folded or collapsed cardboard packagings, remove a folded or collapsed cardboard packaging from a cardboard packaging supply and expand and/or unfold it to a set of compartments and/or to an outer packaging within fractions of seconds.

From WO 2013/053646 A1, an apparatus and a method are known for the combined expanding and unfolding of cardboard packagings to a cover of a container. A cardboard packaging supply in the form of a standing, lying, or hanging magazine accommodates flatly collapsed cardboard packagings being pressed against a removal side of the magazine by a compressive and consisting respectively of four cardboard packaging walls connected with each other along bending edges running in parallel, with respectively two of the cardboard packaging walls forming a top and a bottom flat side—or, in the instance of a lying arrangement of the magazine, a front and rear flat side—of a flatly collapsed cardboard packaging. The removal side of the magazine releases respectively one flat side. A gripper seizes one of the cardboard packaging walls of the flat side of the cardboard packaging located at the removal side of the magazine and pulls the seized cardboard packaging wall and thus the entire cardboard packaging along a path of movement out of the magazine. The path of movement describes a quarter-circular path along which the cardboard packaging wall seized by the gripper undergoes a 90-degrees pivoting movement about an axis running in parallel to the bending edges. During this movement, the cardboard packaging wall, which is not seized by the gripper, of the flat side released by the magazine, which cardboard packaging wall not seized by the gripper in the flatly collapsed state of the cardboard packaging encloses a dull angle of at least approximately 180 degrees with the cardboard packaging wall seized by the gripper, glides along a guiding slot, which, at the end of the path of movement, forces the cardboard packaging wall not seized by the gripper to take an angle of 90 degrees in relation to the cardboard packaging wall seized by the gripper such that a rectangular cross section of the cover is achieved. The separately produced bottom and the separately produced lid of the container are subsequently connected with the cover and the container is filled.

In the lying arrangement of the magazine, the covers can be expanded and unfolded in a standing position. The space requirement of this lying magazine in the horizontal direction is, however, substantial. The arrangement moreover has the disadvantage that the cardboard packagings stored in the magazine and necessarily pressed against the removal side of the magazine for the lying arrangement can get caught, such as is unfortunately known from paper towel dispensers.

Another not insubstantial cost factor in handling articles is the space requirement for the construction of the equipment technology. The greatest cost factor in this context is the required floor space, because most of the facilities do not fully use the ceiling height commonly available in production halls.

A contribution to realizing a minimal horizontal space requirement needed for an as small as possible floor space can be achieved by the cardboard packagings being stacked for storage in a vertical direction.

A disadvantage of this is that the cardboard packagings have to be removed in a lying position and transferred to a device arranged as nearby as possible to their storage, which device expands and/or unfolds the cardboard packagings to compartments and/or outer packagings by an opposite application of force, for instance, by pulling at a cardboard packaging wall of its top and bottom flat sides, respectively, and/or by pressing at their outer bending edges.

A contribution to realizing a minimal horizontal space requirement needed for an as small as possible floor space can also be achieved by the expanding or unfolding of cardboard packagings to compartments and/or outer packagings being carried out as little as possible in a horizontal direction, preferably exclusively in a vertical direction.

A disadvantage of this is that the flatly collapsed cardboard packagings in this way have to be expanded or unfolded in a lying position, whereby access openings, through which articles can be introduced into the interior spaces of the thus created compartments and/or outer packagings, respectively spread open a vertical plane standing normal upon the cardboard packaging walls forming the flat sides of the cardboard packaging. In order to be able to introduce articles into compartments and/or outer packagings, which articles are commonly handled in a standing position until they are placed into a set of compartments and/or into an outer packaging, either the articles have to be laid so that they can be introduced through the access openings, or the compartments and/or outer packagings have to be erected so that the access openings are on a horizontal plane.

This can be carried out by, subsequently to the expanding of flatly collapsed cardboard packagings by means of suction cups, which are movable normal to a plane formed by the flat sides of the still flatly collapsed cardboard packagings, the said suction cups, after expanding the cardboard packaging to lying compartments and/or outer packagings, not releasing them yet, but rather first being rotated about a horizontal pivoting axis before they release the cardboard packaging wall seized by them.

It is obvious that this pivoting of the vertically movable suction cups still requires a substantial amount of space in a horizontal direction. The additional movement path of the suction cups, which are necessarily vertically movable for the purpose of expanding, furthermore negatively affects the achievable pacing.

SUMMARY OF THE INVENTION

One task of the invention is to develop an apparatus and a method for expanding and erecting collapsed or folded cardboard packagings to standing compartments and/or outer packagings, which apparatus has a reduced space requirement in a horizontal direction as compared to the prior art as well as with a higher achievable pacing as compared to the prior art.

The above task is solved respectively by the features of the independent claims. Further advantageous embodiments of the invention are described in the dependent claims.

A first object of the invention correspondingly relates to an apparatus for expanding and erecting collapsed or folded cardboard packagings to standing compartments and/or outer packagings.

In the instance of compartments and/or outer packagings arranged in a standing position, the access openings through which articles can be introduced into the compartments and/or outer packagings are in a horizontal plane.

The apparatus has a cardboard packaging supply comprising at least one stack of flatly collapsed cardboard packagings arranged lying on top of each other.

The cardboard packagings consist of a plurality of cardboard packaging walls interconnected with each other, for instance, by bending edges and/or adhesive joints and/or slot-in connections, which cardboard packaging walls can be cut out and/or punched out from sheet-formed material, for example. In a collapsed state at least two cardboard packaging walls connected with each other form a top and a bottom flat side, respectively, of a flatly collapsed cardboard packaging.

The apparatus further has an erecting device arranged next to the cardboard packaging supply.

The apparatus moreover has a gripping device for simultaneously seizing one respective top cardboard packaging after the other from each stack of the cardboard packaging supply of flatly collapsed cardboard packagings arranged on top of each other.

The number of stacks of the cardboard packaging supply of flatly collapsed cardboard packagings arranged lying one on top of each other preferentially corresponds to the number of cardboard packagings respectively simultaneously seizable or seized, as the case may be, by the gripping device.

Per each cardboard packaging simultaneously seized by the gripping device, the gripping device has at least one tool with which a cardboard packaging lying topmost on a stack of the cardboard packaging supply can be seized and lifted at a cardboard packaging wall of its top flat side.

In order to be able to move the at least one tool of the gripping device horizontally between the cardboard packaging supply and the erecting device, and preferentially, for bridging height differences and/or for expanding cardboard packagings to compartments and/or outer packagings, also vertically in space, the gripping device moreover has at least one manipulator with a manipulator head that is at least horizontally movable along a horizontal axis and preferentially also vertically movable along a vertical axis, at which manipulator head the at least one tool of the gripping device is arranged.

The erecting device and the cardboard packaging supply are arranged next to each other in the direction of the horizontal axis.

Preferentially, the erecting device as well as the surface of the cardboard packaging supply formed by the topmost cardboard packaging of the at least one stack of cardboard packagings are located at the same level, at least in a starting position.

Particularly preferentially, the surface of the cardboard packaging supply formed by the topmost cardboard packaging of the at least one stack of cardboard packagings is located at a level that is higher by at least the height of a lying, expanded set of compartments and/or of a lying, expanded outer packaging than a level of the erecting device formed by the at least one tool of the erecting device in the horizontal position of its at least one carrier. In this way, a vertical stroke of the manipulator head in a return movement from the erecting device to the cardboard packaging supply, which is required for seizing the next cardboard packagings after expanding a cardboard packaging to a lying set of compartments and/or to an outer packaging, is not needed, thus increasing the achievable pacing.

The at least one tool of the gripping device arranged at the at least one manipulator head is thus horizontally movable back and forth between the cardboard packaging supply and the erecting device, which is arranged next to the cardboard packaging supply as seen in the direction of a horizontal axis, as well as being, preferentially, liftable and lowerable. The at least one manipulator can be, for instance, a multi-axis robot arm, for example with six axes, or a gantry or a tripod or quadropod, which is laterally movable back and forth along a horizontal axis as well as, preferably, also being liftable and lowerable along a vertical axis, to name but a few conceivable manipulators.

The erecting device has at least one carrier, which is rotatable back and forth, for instance, by swinging down and back up again, for instance, about a pivoting axis running orthogonal to the horizontal axis and orthogonal to the vertical axis, from a horizontal position into a vertical position and vice versa.

The erecting device has at least one tool arranged at its at least one carrier per each cardboard packaging that is simultaneously seizable or seized, as the case may be, by means of the gripping device, with which tool, in its or, as the case may be, in their horizontal position, at least one cardboard packaging having been brought onto the erecting device by means of the gripping device can be seized and held at a cardboard packaging wall of its bottom flat side, and, after expanding the cardboard packagings by increasing the distance between the tools of the gripping device and the erecting device along the vertical axis, for instance, by vertically lifting the tool of the gripper device arranged at the manipulator head, which is in any event preferentially vertically movable, the lying, expanded compartments and/or outer packagings, which are still being held by the at least one tool of the erecting device, are erected to a standing position along with the subsequent disengaging of only the at least one tool of the gripper device by swinging down the carrier.

At its at least one carrier, the erecting device can have a device designed as a folding flap, for example, which holds in form compartments and/or outer packagings, which are expanded and erected, at least until after the rotating of the at least one carrier of the erecting device about its horizontal pivoting axis running, for instance, orthogonal to the horizontal axis and orthogonal to the vertical axis from a horizontal position into a vertical position, and, as the case may be, prevents them from slipping off the carrier when the at least one tool of the erecting device releases a set of compartments and/or an outer packaging held by it until the end of the expanding.

Alternatively or additionally, a holding device can be provided for each carrier in order to ensure that such sets of compartments and/or outer packagings remain in an expanded state, as would otherwise entirely or partly collapse again after the expanding on being released.

If the erecting device is designed to be vertically movable, it is possible to omit a vertically movable manipulator head, by it only horizontally transferring cardboard packagings from the cardboard packaging supply to the erecting device, and the erecting device increasing the distance between its tools and the tools of the gripping device for expanding the cardboard packagings to lying compartments and/or outer packagings by moving downward.

In summary, the erecting device together with the gripping device at the same time forms an expanding device, which, by increasing the distance between a cardboard packaging wall of a top flat side of a flatly collapsed cardboard packaging being held by at least one tool of the gripping device and a cardboard packaging wall of a bottom flat side of a flatly collapsed cardboard packaging being held by at least one tool of the erecting device, expands these to a lying set of compartments and/or to an outer packaging.

In the instance of compartments and/or outer packagings arranged in a lying position, the access openings through which articles can be introduced into the compartments and/or outer packagings are, other than those of compartments and/or outer packagings that are arranged in a standing position, not in a horizontal, but rather in a vertical plane.

The apparatus can furthermore comprise a control device, which at least:

controls the at least one manipulator of the gripping device such that it carries out a cyclical movement path, in the course of which the manipulator lowers the at least one tool onto a cardboard packaging wall of the top flat side of a cardboard packaging lying topmost on at least one stack of the cardboard packaging supply, lifts it up again, traverses to the erecting device, lowers it onto the erecting device and lifts it back up again and finally traverses over the cardboard packaging supply again, controls the at least one tool of the gripping device such that it, after being lowered, seizes and holds a cardboard packaging wall of the top flat side of a cardboard packaging lying topmost on at least one stack of the cardboard packaging supply until the tool of the gripping device, in the course of the cyclical movement path, has been lifted back up again from the erecting device for at least so far that the cardboard packaging is expanded to a set of compartments and/or to an outer packaging, controls the at least one carrier of the erecting device such that it carries out a cyclical rotating movement path, in the course of which it is rotated about its pivoting axis by 90 degrees from the horizontal to the vertical and back again, wherein the carrier takes up a horizontal position at the latest when the at least one manipulator, during its course of movement, lowers or has lowered the at least one tool of the gripping device onto the erecting device and maintains the horizontal position for as long as until the tool of the gripping device, in the course of the cyclical movement path of the manipulator, has been lifted back up again from the erecting device for at least so far that the cardboard packaging is expanded to a set of compartments and/or to an outer packaging, in order to hereafter take up a vertical position by swinging down and/or rotating about its pivoting axis, and controls the at least one tool of the erecting device such that, after lowering the at least one manipulator, the tool seizes a cardboard packaging wall of the bottom flat side of the at least one cardboard packaging being held by the at least one tool of the gripping device and holds it at least for as long as until the cardboard packaging, which is expanded to a set of compartments and/or to an outer packaging, has been erected and is available for its further use by swinging down and/or rotating the at least one carrier of the erecting device by 90 degrees about its pivoting axis from its horizontal position to its vertical position.

If the erecting device is equipped with a device designed as folding flap at its at least one carrier, which folding flap holds in form compartments and/or outer packagings, which are expanded and erected, at least until after the rotating of the at least one carrier of the erecting device about its horizontal pivoting axis running, for instance, orthogonal to the horizontal axis and orthogonal to the vertical axis from a horizontal position into a vertical position, and, as the case may be, prevents them from slipping off the carrier when the at least one tool of the erecting device releases a set of compartments and/or an outer packaging held by it until the end of the expanding, then the control device can additionally control this folding flap in such a manner that it is flipped open, at the latest, at the end of the expanding process and in the beginning of the rotating of the carrier from its horizontal into the vertical position such that, in end of the erecting process, the folding flap holds in form expanded and erected compartments and/or outer packagings and, supports them, as the case may be, from below, for instance, preferably even after the release of the tool of the erecting device for as long as until the expanded and erected compartments and/or outer packagings are supplied for their further use. The control device can subsequently cause the folding flap to return to its starting position in a folded-in state. Alternatively or additionally, the folding out or folding in of at least the part of the folding flap preventing a slipping off can be carried out gravity-supported and/or gravity-controlled, as the case may be.

In dependence on the configuration of the cardboard packagings and of the compartments and/or outer packagings expandable therefrom, the control device can cause the manipulator to carry out a horizontal movement running in parallel and/or orthogonal to the horizontal axis at the same time while the tool of the gripping device is lifted, at the end of which horizontal movement the cardboard packaging wall of the top flat side of a cardboard packaging having been seized by a tool of the gripping device and the cardboard packaging wall of the bottom flat side of a cardboard packaging having been seized by a tool of the erecting device are arranged superposed upon each other as seen from a top view in a horizontal direction, corresponding to two opposite walls of an expanded set of compartments and/or an outer packaging.

Preferably, however, the cardboard packagings are configured such that they can be expanded by a mere increase of distance between the tools of the gripping device and the erecting device. This is possible, for instance, by way of an accordion-like structure with an even number of cardboard packaging walls connecting the cardboard packaging walls being held by the tools at respectively one of their narrow sides with each other.

In dependence on the design of the cardboard packaging, the lifting following the lowering onto the erecting device can thus be carried out exclusively in a vertical direction.

In order to achieve an as high as possible pacing, the control device can cause combined movements of the manipulator in a horizontal and a vertical direction before and after the erecting of cardboard packagings to compartments and/or outer packagings.

As at least one tool per each simultaneously seized cardboard packaging, the gripping device has at least one downwardly directed suction cup, which, by impingement with a vacuum, is able to hold a cardboard packaging lying respectively topmost on a stack of the cardboard packaging supply at one of the cardboard packaging walls of its top flat side by means of the vacuum.

A suction cup has a downwardly open sleeve of an elastic, airtight material as well as a connection leading upward and away from the sleeve for a vacuum source, such as, for instance, a vacuum pump or a negative pressure pump, or a vacuum accumulator connected with a vacuum pump or a negative pressure pump. Preferably, a control opening and closing valve is arranged between each suction cup assigned to a cardboard packaging and the vacuum source. The vacuum source communicates with the suction cup when the valve is opened. In the instance of the downwardly open sleeve not being covered, air flows through the suction cup to the vacuum source, which, strictly speaking, thus represents a drain for the air that is under ambient pressure. In the instance of the downwardly open sleeve being blocked by a cardboard packaging wall, a vacuum forms in the suction cup, and the cardboard packaging wall together with the associated cardboard packaging are held.

Preferably, the gripping device has at least four downwardly directed suction cups as tool per each simultaneously seized cardboard packaging, which suction cups can hold a cardboard packaging lying respectively topmost on a stack in the area of the corners of one of the cardboard packaging walls of its top flat side by means of the vacuum. In comparison to only one suction cup per each simultaneously seized cardboard packaging, this has the advantage of greater redundancy and, at the same time, a greater holding force, which, as explained above, is required for expanding the folded cardboard packagings.

The at least one suction cup of the gripping device per stack of the cardboard packaging supply is arranged at the manipulator, whereby the suction cup can be lowered onto the cardboard packaging supply, lifted back up again with a suction-held cardboard packaging, be laterally traversed to the erecting device and lowered onto it and lifted back up again as well as traversed back to the cardboard packaging supply after the release of the cardboard packaging, which has then been expanded to a set of compartments and/or to an outer packaging.

Preferably, this at least one tool of the erecting device is also one or more suction cups, for instance.

The cardboard packaging supply can comprise an uprightly standing magazine accommodating one or more stacks, which magazine is accessible from its top side for removing cardboard packagings. If a plurality of stacks are accommodated in the magazine, they are preferentially at least partly separated by magazine partition walls and/or accommodated in the magazine spaced apart such as will exclude any contact of the individual cardboard packagings of adjacent stacks in the magazine. In this way, the topmost cardboard packagings simultaneously removed from a plurality of stacks of the cardboard packaging supply are prevented from getting caught, thus increasing the operating safety of the apparatus.

Preferably, the cardboard packaging supply has two or more stacks of flatly collapsed cardboard packagings arranged lying stacked on top of each other, which stacks are adjacent next to each other as seen in a horizontal direction in parallel to the pivoting axis of the at least one carrier of the erecting device.

Two or more stacks of the cardboard packaging supply of flatly collapsed cardboard packagings arranged lying stacked on top of each other, which stacks are adjacent next to each other as seen in a horizontal direction in parallel to the pivoting axis of the at least one carrier of the erecting device, can be arranged offset from one another in a horizontal direction orthogonal to the pivoting axis of the at least one carrier of the erecting device, or they can be aligned with each other as seen in parallel to the pivoting axis of the at least one carrier of the erecting device.

Alternatively or additionally, stacks of the cardboard packaging supply of flatly collapsed cardboard packagings arranged lying stacked on top of each other, which stacks are adjacent next to each other as seen in a horizontal direction in parallel to the pivoting axis of the at least one carrier of the erecting device, can be twisted relative to each other by 90 degrees or 180 degrees or 270 degrees or they can be arranged mirror-invertedly corresponding to a mirroring at a mirror axis running in orthogonal to the pivoting axis of the at least one carrier of the erecting device between two adjacent stacks or at a mirror point located between the adjacent stacks.

Preferentially, the erecting device has at least two carriers, which are rotatable from a horizontal position to a vertical position and vice versa respectively about an own pivoting axis. The pivoting axes of the carriers in this instance run in parallel. As seen in a horizontal direction orthogonal to the pivoting axes, the cardboard packaging supply has a number of adjacent stacks of flatly collapsed cardboard packagings arranged lying on top of each other, their number corresponding to the number of carriers that are respectively rotatable about their own pivoting axes.

Particularly preferentially, the erecting device has two carriers, which are rotatable in opposite directions from a horizontal position to a vertical position and vice versa respectively about their own pivoting axis. The pivoting axes of the carriers run in parallel in this instance, too. As seen in a horizontal direction orthogonal to the pivoting axes, the cardboard packaging supply has two adjacent stacks of flatly collapsed cardboard packagings arranged lying on top of each other. The lying, stacked cardboard packagings of a first stack of the two stacks, which are adjacent next to each other as seen in a horizontal direction orthogonal to the pivoting axes, here are preferably stacked, as seen in relation to a mirror axis running in parallel to the pivoting axes between the two stacks, mirror-invertedly with respect to cardboard packagings, which are also stacked lying, of a second stack of the two stacks, which are adjacent as seen in a horizontal direction orthogonal to the pivoting axes.

Both for the same and for opposite rotating directions of two or more carriers of the erecting device about their respectively own pivoting axes can the stacks of the cardboard packaging supply of flatly collapsed cardboard packagings, which are adjacent as seen in a horizontal direction orthogonal to the pivoting axes, be arranged to be aligned with each other or offset from each other in relation to a horizontal axis running orthogonal to the pivoting axes. In this way, the arrangement of the stacks in the cardboard packaging supply can be adapted to the folding of the cardboard packagings such that, after the expanding and erecting of cardboard packagings from stacks correspondingly adjacent to each other in the cardboard packaging supply to compartments and/or outer packagings, the cardboard packagings are arranged, for instance, aligned with each other or offset from each other in relation to a horizontal axis running orthogonal to the pivoting axes.

Similarly as already described for stacks of the cardboard packaging supply arranged adjacent next to each other as seen along the pivoting axes, it is generally also conceivable here to have stacks of the cardboard packaging supply of flatly collapsed cardboard packagings arranged lying stacked on top of each other, which stacks are adjacent next to each other and can be twisted relative to each other by 90 degrees or 180 degrees or 270 degrees or can be arranged mirror-invertedly corresponding to a mirroring at a mirror axis running orthogonal to the pivoting axis of the at least one carrier of the erecting device between two adjacent stacks or at a mirror point located between the adjacent stacks.

If the erecting ends in an offset arrangement and if an aligned arrangement is required for the further handling, it is alternatively conceivable to arrange the carriers of the erecting device movably in parallel to their pivoting axes relative to each other, in order to transfer expanded compartments and/or outer packagings that were erected by means of different carriers of the erecting device into an arrangement aligned with each other.

Each or only one of the carriers of the erecting device can be movably arranged in a horizontal direction relative to each other and/or together with each other such that they can be moved apart from each other during their preferably simultaneous rotating about their pivoting axes in order to prevent a clashing of expanded compartments and/or outer packagings during the rotating and/or such that they can be moved toward each other and/or in parallel to each other after reaching the vertical position in order to achieve a grouping of the expanded and erected compartments and/or outer packagings. An adaptation to compartments and/or outer packagings with different external dimensions is thus moreover possible.

By a horizontal movability of the carrier or carriers of the erecting device orthogonal to its or their pivoting axes, a stripping of the expanded and erected compartments and/or outer packagings is further possible, which compartments and/or outer packagings, after the disengaging of the tools of the erecting device, remain standing on devices arranged at the carriers of the erecting device, designed, for instance, as a folding flap for each carrier, which devices prevent expanded compartments and/or outer packagings being erected after the rotating of the carriers of the erecting device about their horizontal pivoting axes running, for instance, orthogonal to the horizontal axis and orthogonal to the vertical axis from a horizontal position into a vertical position, from slipping off the carrier when tools of the erecting device release compartments and/or outer packagings being held by them at least until the end of the expanding.

The apparatus can comprise a transfer device, which receives expanded and erected compartments and/or outer packagings from the erecting device, preferentially from the vertical position of the carrier of the erecting device, and supplies them to their further use, for instance, by subsequent inserting of expanded and erected compartments into outer packagings staged elsewhere and/or by the placing of articles into compartments and/or outer packagings.

Arranged at a manipulator, the transfer device can comprise a tool, which receives expanded and erected compartments and/or outer packagings from the erecting device and discharges them by way of a vertical and/or horizontal movement of the manipulator.

Alternatively, the compartments and/or outer packagings, which are erected to a standing position after the rotating of the at least one carrier of the erecting device, can also be released by simply disengaging the at least one tool of the erecting device and thus be transferred, for instance, to a horizontal conveyor passing immediately below the erecting device. In this instance, the vertical distance between such a horizontal conveyor and the erecting device can be adjusted such that the compartments and/or outer packagings, which are erected to a standing position after the rotating of the at least one carrier from its horizontal position to its vertical position, take up an as small as possible distance to the surface of the horizontal conveyor, for instance, grazing the surface. Furthermore conceivable is a set down movement of the erecting device in a vertical direction prior to the release.

The at least one tool of the transfer device can comprise at least one suction cup.

A second object of the invention relates to a method for expanding and erecting collapsed or folded cardboard packagings to standing compartments and/or outer packagings.

The method provides to hold the topmost cardboard packaging, coming from above, at a cardboard packaging wall of its top flat side from a stack of flatly collapsed cardboard packagings arranged on top of each other of a supply of cardboard packagings, and to remove it from the stack.

The method subsequently provides to also hold the cardboard packaging, which is being held at a cardboard packaging wall of its top flat side, at a cardboard packaging wall of its bottom flat side from below, as well, and to increase the vertical distance between the cardboard packaging wall, at which the cardboard packaging is being held at its top flat side, and the cardboard packaging wall, at which the cardboard packaging is being held at its bottom flat side, by oppositely pulling so far until the cardboard packaging has been expanded to a lying set of compartments and/or to a lying outer packaging.

The method then provides to release the expanded set of compartments and/or the outer packaging at its cardboard packaging wall that was previously assigned to the top flat side of the cardboard packaging.

Finally, the method provides to tilt the lying, expanded set of compartments and/or the outer packaging still being held at its cardboard packaging wall that was previously assigned to the bottom flat side of the cardboard packaging about a horizontal pivoting axis and to subsequently also release the expanded and now erected set of compartments and/or the outer packaging at its cardboard packaging wall that was previously assigned to the bottom flat side of the cardboard packaging.

The method preferably provides to simultaneously expand and erect a plurality of cardboard packagings to compartments and/or outer packagings in the manner described.

Here, respectively two cardboard packagings can form a pair of cardboard packagings to be simultaneously expanded and erected to compartments and/or outer packagings, which, after having been expanded to lying compartments and/or outer packagings, are erected to standing compartments and/or outer packagings in the same or the opposite rotating direction about respectively own horizontal pivoting axes running in parallel.

The cardboard packagings of a pair of cardboard packagings to be simultaneously expanded and erected to compartments and/or outer packagings can be arranged aligned or offset to each other prior to the expanding. Alternatively or additionally, the cardboard packagings of a pair of cardboard packagings to be simultaneously expanded and erected to compartments and/or outer packagings can be arranged twisted relative to each other by 90 degrees, 180 degrees, 270 degrees, for example, and/or mirror-invertedly to a mirror axis or a mirror point prior to the expanding.

The compartments and/or outer packagings simultaneously expanded and erected from a pair of cardboard packagings can be arranged aligned or offset to each other after the expanding. Alternatively or additionally, the compartments and/or outer packagings simultaneously expanded and erected from a pair of cardboard packagings can be arranged twisted relative to each other by 90 degrees, 180 degrees, 270 degrees, for example, and/or mirror-invertedly to a mirror axis or a mirror point after the expanding.

A plurality of cardboard packagings or pairs of cardboard packagings can be simultaneously expanded next to each other, as seen in a direction in parallel to the pivoting axis or axes, to lying compartments and/or outer packagings and subsequently be erected to standing compartments and/or outer packagings.

It is obvious that the invention can be realized by an erecting of compartments and/or outer packagings expanded from previously lying cardboard packagings, by continuing, even after releasing their cardboard packaging walls previously assigned to the top flat sides of the cardboard packagings, to hold the expanded compartments and/or outer packagings at their cardboard packaging walls previously assigned to the bottom flat sides of the cardboard packagings, and subsequently rotating them by 90 degrees about a horizontal pivoting axis of an erecting device still holding the compartments and/or outer packagings at their cardboard packaging walls previously assigned to the bottom flat sides of the cardboard packagings.

Both the apparatus and the method can alternatively or additionally have individual or a combination of a plurality of features initially described in connection with the prior art and/or in one or more documents mentioned regarding the prior art.

Moreover, the apparatus can alternatively or additionally have individual or a combination of a plurality of features described previously or in the following in connection with the method, as well as the method can alternatively or additionally have individual or a combination of a plurality of features described previously or in the following in connection with the apparatus.

It is important to emphasize that the further use of the expanded and erected compartments and/or outer packagings can provide to supply these to a facility for handling articles, which facility comprises a first conveyor for the supply of articles, a second conveyor for the supply of outer packagings as well as a third conveyor for the discharge of outer packagings with articles placed therein.

The facility furthermore comprises a placing surface arranged between the second and the third conveyor as well as a device for transferring supplied outer packagings from the second conveyor to the placing surface.

Moreover, the facility comprises a device for transferring articles from the first conveyor into outer packagings having been transferred onto the placing surface.

The device for transferring articles first seizes the articles staged by means of the first conveyor, then transfers the seized articles from the first conveyor to the placing surface and, in the process of transferring the articles having been seized by the device and having been transferred from the first conveyor to the placing surface, places them into the outer packagings having been transferred onto the placing surface.

The facility further comprises a device for transferring outer packagings with articles placed therein from the placing surface onto the third conveyor.

The device for transferring outer packagings from the second conveyor onto the placing surface can comprise the device for transferring outer packagings with articles placed therein from the placing surface onto the third conveyor, or it can comprise one or more parts of the device for transferring outer packagings with articles placed therein from the placing surface onto the third conveyor, or it can be completely or partly comprised by the device for transferring outer packagings with articles placed therein from the placing surface onto the third conveyor.

The device for transferring supplied outer packagings from the second conveyor to the placing surface and the device for transferring outer packagings with articles placed therein from the placing surface onto the third conveyor thus each in themselves or together form at least one transfer device that is formed and operatable independently of the device for transferring articles from the first conveyor into outer packagings having been transferred onto the placing surface.

The placing surface in connection with the at least one transfer device that is independent of the device for transferring articles from the first conveyor into outer packagings having been transferred onto the placing surface results in an increase in performance with regard to the pacing that is achievable based on a facility without placing surface. The higher pacing is achieved, because, by means of the placing surface in connection with the at least one transfer device that is independent of the device for transferring articles, articles supplied by means of the first conveyor can be seized by the device for transferring articles in a first cycle, and the device for transferring articles can begin with transferring the seized articles by starting a movement of the seized articles from the first conveyor to the placing surface while outer packagings that are still empty are simultaneously pushed off from the second conveyor to the placing surface and outer packagings with articles placed therein are pushed over from the placing surface onto the third conveyor, and in a second cycle new, empty outer packagings can be supplied by means of the second conveyor and outer packagings with articles placed therein can simultaneously be discharged from the third conveyor, while the transferring of the articles having been seized in the first cycle is simultaneously completed by placing articles into the outer packagings staged on the placing surface.

In this context, the transferring of the articles seized in the first cycle is concluded by placing the articles having been seized by the device for transferring articles into empty outer packagings having been pushed off onto the placing surface in the first cycle, and by a return of the device for transferring articles from the placing surface to the first conveyor at least being started, in order to again seize and transfer articles supplied from the first conveyor.

Preferably, the first conveyor, the second conveyor, and the third conveyor are arranged in parallel to each other along the placing surface, at least in the area of their portions abutting on the placing surface. In the arrangement in parallel to each other, the transport directions of the conveyor run in parallel to each other at least in the area of their portions abutting on the placing surface. This applies to transport directions of all conveyor running in the same direction as well as to transport directions of at least two conveyor running in opposite directions.

The parallely arranged portions of the conveyor preferably overlap one another by the length of at least two outer packagings. In this way, two or more outer packagings can be staged simultaneously on the placing surface, and articles can be simultaneously placed into the plurality of staged outer packagings. The pacing can thus be further increased.

The direction of the transfer of outer packagings, termed for short transfer direction and being carried out by the device for transferring empty outer packagings from the second conveyor to the placing surface, runs, in a horizontal direction, preferably transversely, preferentially orthogonal to the transport direction of the second conveyor.

The direction of the transfer of outer packagings with articles placed therein, termed for short transfer direction and being carried out by the device for transferring outer packagings with articles placed therein from the placing surface to the third conveyor, runs, in a horizontal direction, preferably transversely, preferentially orthogonal to the transport direction of the third conveyor.

In the transfer from the second conveyor to the placing surface and from the placing surface to the third conveyor, the transfer direction of the device or of the devices for transferring preferably both the empty outer packagings and the outer packagings with articles placed therein thus preferentially runs, in a horizontal direction, preferably transversely, preferentially orthogonal to the transport directions of both the second conveyor and the third conveyor.

By the transversal and preferably orthogonal horizontal transfer direction in relation to the transport directions of the second and the third conveyor, a plurality of empty outer packagings as well as a plurality of outer packagings with articles placed therein can be respectively simultaneously transferred from the second conveyor to the placing surface as well as from the placing surface to the third conveyor, whereby articles can be simultaneously placed into a plurality of outer packagings that have been put down on the placing surface. The pacing can thus be significantly increased.

The device for transferring outer packagings from the second conveyor onto the placing surface and/or the device for transferring outer packagings with articles placed therein from the placing surface onto the third conveyor can comprise at least one slider.

The second and the third conveyor as well as the placing surface are preferentially located on a common, first level, whereas the first conveyor is preferably located on a higher, second level. A vertical stroke of the device for transferring articles, which vertical stroke is necessary for placing articles into outer packagings, can thus be reduced to the essential, whereby the pacing can be further increased.

Preferably, the second level is located above the first level by at least the height of an outer packaging, which is initially open and to be closed after placing the articles therein, as the case may be. In the instance of flaps for closing that protrude to the top from an outer packaging designed as a closable cardboard packaging, the second level is preferentially located accordingly higher, by the height of the flaps protruding above the first level, than in the instance of the outer packaging being closed, for instance, with a separately provided lid.

The closing of the outer packagings with articles placed therein can be carried out while still on the placing surface, for instance, together with or subsequent to placing the articles, or in a separate treatment step, for instance, subsequent to or in the further course of the third conveyor of the facility for handling articles. For instance, the outer packagings with articles placed therein can be closed with lids in the further course of the third conveyor.

Prior to placing the articles into outer packagings having been transferred onto the placing surface, compartments, also termed so-called baskets, can be inserted into the outer packagings, which compartments assign fixed positions to the articles within the outer packagings and thus protect them, during the further transport of the outer packagings with articles placed therein until the articles are withdrawn and consumed, from colliding with each other and rubbing against each other, which otherwise would lead to a negative impression of the quality by scuffing, for instance, of information applied onto the articles in the form of labels, for example, and/or by the articles damaging each other.

The compartments can already have been or be inserted into the outer packagings prior to the transfer of the outer packagings to the placing surface, or the compartments can be inserted into the outer packagings prior to or together with or after the articles being placed into the outer packagings. The subsequent introduction of compartments, in particular with lightweight articles that are shiftable with little effort within the outer packagings, has the advantage of a simpler placing of the articles in the outer packagings, along with a reduced effort for controlling, because articles with a shape, for example, tapering conically or in a similar manner toward their oppositely located contact surfaces, such as beverage bottles with a bottle neck widening at least sectionwise from the top downward, can be horizontally shifted within the outer packagings by the compartments when these are inserted.

The compartments can be introduced into the outer packagings, for instance, while still on the second conveyor, or they can be introduced into the outer packagings, for instance, already together with or subsequent to erecting these, or they can already be integrated into an according cardboard packaging, wherein the compartments unfold within the outer packaging when the cardboard packaging is erected.

In connection with introducing compartments prior to or after placing articles into the outer packagings, a separate introduction surface can alternatively be provided between the second conveyor and the placing surface, in the instance of the introduction prior to placing the articles, or between the placing surface and the third conveyor, in the instance of the introduction after placing the articles. Accordingly, an additional device for transfer, which can also be part of a transfer device or comprised by it, can be provided.

In the further course of the third conveyor of the facility for handling articles, a stacking station can be provided, where, for instance, closed outer packagings with articles placed therein are grouped into stack layers and stacked onto a stack, which is then discharged in order to make room for stacking up a new stack after reaching a specified stacking height according to a specified number of stack layers stacked on top of each other at the stacking station.

The articles supplied by means of the first conveyor are preferentially already sorted into article groups to be respectively placed into an outer packaging. The articles supplied by means of the first conveyor can abut on each other or they can be supplied lined up one after the other with gaps between them. The articles supplied by means of the first conveyor can be supplied in one row or in a plurality of rows running in parallel. For this purpose, the articles can be transferred to the first conveyor via a suitable infeed, and be guided in one or in a plurality of lanes oriented in parallel to each other after the transfer to the first conveyor.

The articles supplied by means of the first conveyor accordingly form a single- or multiple-row article flow of articles lined up one after the other uninterruptedly and/or with gaps between them.

Before the articles are subsequently placed into the outer packagings by means of the facility for handling articles, the said articles can have been previously treated along an infeed to the first conveyor, for instance, by producing a container and/or cleaning an outer and/or inner surface and/or cooling and/or filling and/or closing, in order to name only a few examples of treating articles without claim to completeness of the list, and/or the articles can have been previously handled along an infeed to the first conveyor, for instance, by separating a number of articles from one or more article flows of articles being transported immediately following each other and/or grouping a number of articles into article groups and/or compiling and assembling a number of articles into bundles, in order to name only a few examples of handling articles without claim to completeness.

The conveyor preferentially comprise at least one horizontal conveyor device, such as for instance, a belt conveyor and/or a roller conveyor.

The outer packagings can preferentially be cardboard packagings, for instance, in the form of cardboard boxes with or without compartments arranged or arrangeable therein for separating and/or keeping apart individual articles from each other.

It is obvious that the further use of previously expanded and erected compartments and/or outer packagings can be realized by a facility for handling articles with:

a first conveyor supplying articles in a first transport direction, a second conveyor supplying outer packagings in a second transport direction preferentially directed in parallel to and running in the same direction as or opposite to the first transport direction, a third conveyor discharging outer packagings with articles placed therein in a third transport direction preferentially directed in parallel to and running in the same direction as or opposite to the first and second transport direction, a placing surface arranged between the second conveyor, a device for transferring supplied outer packagings from the second conveyor to the placing surface, a device for transferring articles from the first conveyor into outer packagings having been transferred onto the placing surface, and a device for transferring outer packagings with articles placed therein from the placing surface onto the third conveyor, wherein the device for the transfer of supplied outer packagings from the second conveyor to the placing surface and the device for the transfer of outer packagings with articles placed therein from the placing surface onto the third conveyor can be combined in one common transfer device.

The further use of previously expanded and erected compartments and/or outer packagings can be realized in the context of a method for handling articles, which method provides that articles are placed into outer packagings staged on a placing surface, which articles are supplied in one or in a plurality of article flows of articles lined up one after the other uninterruptedly and/or with gaps between them and/or grouped, which outer packagings themselves in turn are supplied independently of the articles in a transport direction and are transferred onto the placing surface individually or groupwise transversely to the transport direction and, after the articles have been placed therein, they are transferred from there in turn individually or groupwise transversely to the transport direction—now provided with articles placed therein—in order to be subsequently discharged in the direction of the transport direction or opposite to it in parallel to the transport direction independently of the supply of articles, independently of the supply of outer packagings, and independently of the placing of articles into the outer packagings.

BRIEF DESCRIPTION OF THE FIGURES

In the following passages, the attached figures further illustrate exemplary embodiments of the invention and their advantages. The size ratios of the individual elements in the figures do not necessarily reflect the real size ratios. It is to be understood that in some instances various aspects of the invention may be shown exaggerated or enlarged in relation to other elements to facilitate an understanding of the invention. The same or equivalent elements of the invention are designated by identical reference characters. Furthermore and for the sake of clarity, only the reference characters relevant for describing the respective figure are provided. It should be understood that the detailed description and specific examples of the device and method according to the invention, while indicating preferred embodiments, are intended for purposes of illustration only and are not intended to limit the scope of the invention. The schematic illustrations show as follows.

DETAILED DESCRIPTION OF THE INVENTION

Figure 17:
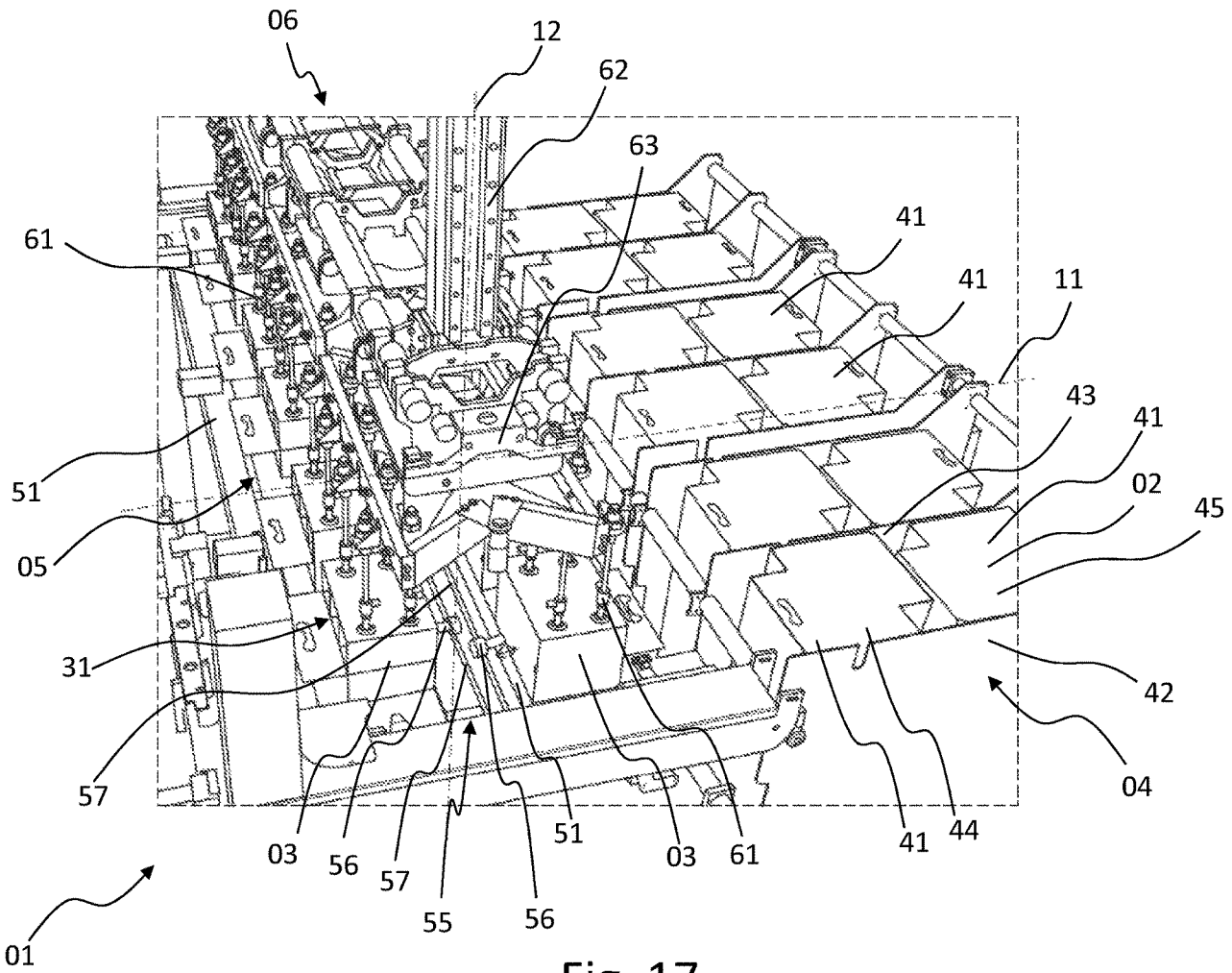
FIG. 17 shows a perspective view of a representation of an additional exemplary embodiment corresponding the snapshot illustration in FIG. 6.
Figure 18:
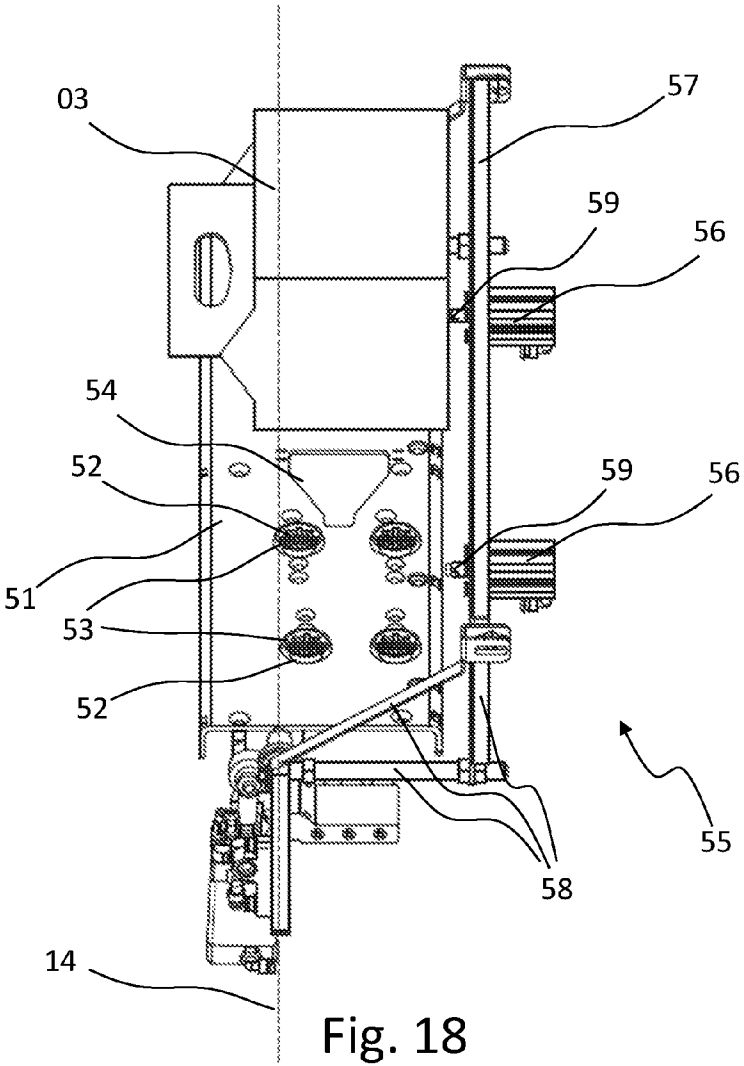
FIG. 18 gives an enlarged view of a part according to a further exemplary embodiment, the view showing a carrier, which is rotatable back and forth about a horizontal pivoting axis from a horizontal position to a vertical position and vice versa, as seen in a perspective view at an angle from above along the horizontal pivoting axis.

An apparatus 01 as illustrated entirely or in parts in FIG. 1 to FIG. 14 as well as in FIG. 17 and FIG. 18 for expanding and erecting collapsed or folded cardboard packagings 02 to standing compartments and/or outer packagings 03, comprising:

a cardboard packaging supply 04 consisting of at least one stack 41 of flatly collapsed cardboard packagings 02 arranged lying on top of each other, an erecting device 05 arranged next to the cardboard packaging supply 04 as seen in the direction of a horizontal axis 11 indicated by a dashed line, and a gripping device 06 for simultaneously seizing one respective top cardboard packaging 02 after the other from each stack 41 of the cardboard packaging supply 04 of flatly collapsed cardboard packagings 02 arranged on top of each other.

The number of stacks 41 of the cardboard packaging supply 04 of flatly collapsed cardboard packagings 02 arranged lying one on top of each other preferentially corresponds to the number of cardboard packagings 02 respectively simultaneously seizable or seized, as the case may be, by the gripping device 06.

The cardboard packaging supply 04 of an apparatus 01 for expanding and erecting collapsed or folded cardboard packagings 02 to standing compartments and/or outer packagings 03, can comprise, for instance, twelve stacks 41 of flatly collapsed cardboard packagings 02 arranged lying on top of each other, as illustrated in FIG. 1 to FIG. 14. The gripping device 06 of a corresponding apparatus 01 is accordingly designed for simultaneously seizing a total of twelve cardboard packagings 02 correspondingly respectively of one top cardboard packaging 02 from each stack 41 of the cardboard packaging supply 04 of flatly collapsed cardboard packagings 02 arranged on top of each other.

Figure 15:
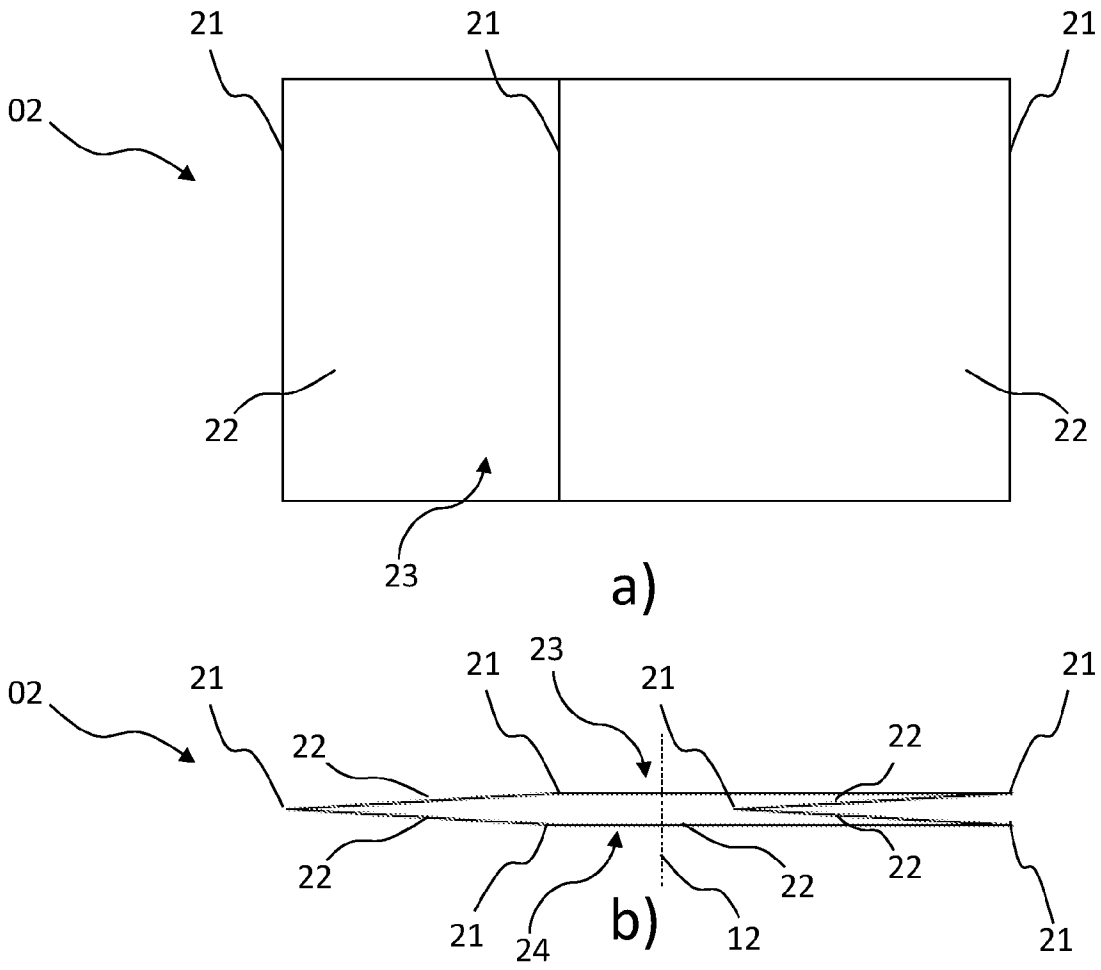
FIG. 15 shows a flatly collapsed cardboard packaging in a top view onto its top flat side formed by two cardboard packaging walls as seen in FIG. 15 *a*) and in a side view in FIG. 15 *b*).

As illustrated in FIG. 15, the cardboard packagings 02 respectively consist of a plurality of cardboard packaging walls 22 interconnected with each other, for instance, by bending edges 21 and/or adhesive joints and/or slot-in connections, which cardboard packaging walls 22 can be cut out and/or punched out from sheet-formed material, for example, and of which at least two cardboard packaging walls 22 connected with each other form a top flat side 23 and a bottom flat side 24, respectively, of a flatly collapsed cardboard packaging 02.

Per each cardboard packaging 02 simultaneously seizable or seized, as the case may be, by the gripping device 06, the gripping device 06 has at least one preferentially downwardly directed tool 61 with which a cardboard packaging 02 lying topmost on a stack 41 of the cardboard packaging supply 04 can be seized and held at a cardboard packaging wall 22 of its top flat side 23.

The gripping device 06 has at least one manipulator 62 with a manipulator head 63 that is at least horizontally movable along a horizontal axis 11, and preferentially also vertically movable along a perpendicular vertical axis 12 indicated by a dashed line, at which manipulator head 63 the at least one tool 61 of the gripping device 06 is arranged. By means of the manipulator 62 and its manipulator head 63 respectively, the at least one tool 61 of the gripping device 06 can be moved at least horizontally between the cardboard packaging supply 04 and the erecting device 05, and preferentially, for bridging height differences and/or for expanding cardboard packagings 02 to compartments and/or outer packagings 03, also vertically in space.

The erecting device 05 has at least one carrier 51, which is rotatable back and forth, for instance, by swinging down and back up again, about a horizontal pivoting axis 13, indicated by dashed lines, from a horizontal position, as illustrated in FIG. 3, FIG. 4, FIG. 5, FIG. 6, FIG. 7, FIG. 8, into a vertical position, as illustrated in FIG. 1, FIG. 10, FIG. 11, FIG. 12, FIG. 13, FIG. 14 and vice versa.

Per each cardboard packaging 02 that is simultaneously seizable or seized, as the case may be, by the gripping device 06, the erecting device 05 has one tool 52 arranged at its at least one carrier 51, which tool 52 is preferentially upwardly directed in the horizontal position of the carrier or carriers 51. With the at least one tool 52, at least one cardboard packaging 02 having been brought onto the erecting device 05 by means of the gripping device 06 is seized in the horizontal position of the carrier 51 and held at a cardboard packaging wall 22 of its bottom flat side 24 at least until after the rotating of the at least one carrier 51 from its horizontal position into its vertical position. This rotating of the at least one carrier 51 from its horizontal position into its vertical position is here only carried out subsequently to the expanding of the cardboard packaging 02 to a lying set of compartments and/or to an outer packaging 03 as carried out by an increase of the distance between the tools 61, 52 of the gripping device 06 and the erecting device 05 along a vertical axis 12 and the release of the at least one tool 61 of the gripping device 06 after the expanding. The lying, expanded set of compartments and/or the outer packaging 03 is erected to a standing position by the rotating.

The erecting device 05 together with the gripping device 06 thus at the same time forms an expanding device, which, by increasing the distance between a cardboard packaging wall 22 of a top flat side 23 of a flatly collapsed cardboard packaging 02 being held by at least one tool 61 of the gripping device 06 and a cardboard packaging wall 22 of a bottom flat side 24 of a flatly collapsed cardboard packaging 02 being held by at least one tool 52 of the erecting device 05, expands these to a lying set of compartments and/or to an outer packaging 03.

The erecting device thus at the same time forms a particularly compact expanding and erecting station with extremely small space requirement in a horizontal direction. A particularly high pacing is furthermore achieved by the simultaneous expanding and erecting of a plurality of cardboard packagings being removed from a plurality of stacks of the cardboard packaging supply arranged next to each other and/or one after the other in relation to the horizontal axis.

In the instance of compartments and/or outer packagings 03 arranged in a standing position, the access openings 31 through which articles can be introduced into the compartments and/or outer packagings 03, are in a horizontal plane running in parallel to the pivoting axis 13 of the at least one carrier 51 and in parallel to the horizontal axis 11 as well as normal to the vertical axis 12.

In the instance of compartments and/or outer packagings 03 arranged in a lying position, the access openings 31 through which articles can be introduced into the compartments and/or outer packagings 03 are, in contrast to those of compartments and/or outer packagings 03 arranged in a standing position, not in a horizontal, but rather in a vertical plane.

The at least one tool 61 of the gripping device 06 arranged at the manipulator head 63 of the at least one manipulator 62 is horizontally movable back and forth between the cardboard packaging supply 04 and the erecting device 05, which is arranged next to the cardboard packaging supply 04 as seen in the direction of a horizontal axis 11, as well as being, preferentially, liftable and lowerable. The at least one manipulator 62 can be, for instance, a multi-axis robot arm, for example with six axes, or a gantry or a tripod or quadropod, which is laterally movable back and forth along a horizontal axis as well as being liftable and lowerable along a vertical axis, to name but a few conceivable manipulators 62.

The at least one carrier 51 of the erecting device 05 can be rotatable back and forth about any pivoting axis running in the horizontal. Preferentially, however, the erecting device 05 has at least one carrier 51, which is rotatable back and forth from a horizontal position to a vertical position and vice versa about a horizontal pivoting axis 13 running orthogonal to the horizontal axis 11 and orthogonal to the vertical axis 12, as is the case for the apparatus 01 illustrated in FIG. 1 to FIG. 14.

If the manipulator head 63 is not only movable along the horizontal axis 11, but additionally also vertically along a vertical axis 12, the increase of the distance between the tools 61, 52 of the gripping device 06 and the erecting device 05, as seen along the vertical axis 12, as is necessary for the expanding of cardboard packagings 02 to lying compartments and/or outer packagings 03, is preferentially carried out by vertically lifting the tool 61 of the gripper device 06 arranged at the manipulator head 63.

Alternatively or in addition to a vertically movable manipulator 62, the erecting device 05 can be designed to be vertically movable by a vertically movable arrangement of the at least one carrier 51 in relation to its pivoting axis 13 or together with its pivoting axis, for instance.

An increase of the distance between the tools 61, 52 of the gripping device 06 and the erecting device 05, as seen along the vertical axis 12, as is necessary for the expanding of cardboard packagings 02 to lying compartments and/or outer packagings 03 can be carried out, in an apparatus 01 with an erecting device 05 designed to be vertically movable, by vertically lowering the at least one tool 52 of the erecting device 05 arranged at the at least one carrier 51.

If the erecting device 05 is designed to be vertically movable, it is possible to omit a vertically movable manipulator head 63, by the gripping device only horizontally transferring cardboard packagings 02 from the cardboard packaging supply 04 to the erecting device 05, and the erecting device 05 increasing the distance between its tools 52 and the tools 61 of the gripping device 06 for expanding the cardboard packagings 02 to lying compartments and/or outer packagings 03 by moving downward.

At its at least one carrier 51, the erecting device 05 can have at least one device 54 (FIG. 2) designed, for instance, as a folding flap, which holds in form, at until after the rotating, expanded compartments and/or outer packagings 03 being erected after the rotating of the at least one carrier 51 of the erecting device 05 about its horizontal pivoting axis 13 running, for instance, orthogonal to the horizontal axis 11 and orthogonal to the vertical axis 12 from a horizontal position into a vertical position, and, as the case may be, prevents them from slipping off the carrier 51 when the at least one tool 52 of the erecting device 05 releases a set of compartments and/or an outer packaging 03 held at least by it until the end of the expanding.

In order to ensure that such sets of compartments and/or outer packagings 03 remain in an expanded state, as would entirely or partly collapse again after the expanding on being released, a holding device 55 can be provided for each carrier 51, which holding device 55 is arranged at the carrier 51 and rotatable together with it about the pivoting axis 13, as illustrated in FIG. 17, or, as illustrated in FIG. 18, is arranged to be rotatable independently of the carrier 51, synchronously together with it and/or time-delayed in relation to it, about an own pivoting axis 14 running in parallel to or coinciding with the pivoting axis 13.

By a rotating of the holding device 55 about the pivoting axis 14 independently of the rotating of the carrier 51 about the pivoting axis 13, the holding device 55 can be rotated away independently of the carrier 51 after the erecting of the compartments and/or outer packagings 03 such that, in an arrangement of the holding device 55 below the compartments and/or outer packagings 03 after the erecting, the expanded and erected compartments and/or outer packagings 03 can also be passed on downward.

In an arrangement of the holding device at the carrier 51 and/or in a synchronous rotating together with the carrier 51 about the pivoting axis 13, the expanded and erected compartments and/or outer packagings 03 can either be only removed toward the top, if the holding device 55 is arranged below the compartments and/or outer packagings 03 after the erecting, or they can only be passed on downward, if the holding device 55 is arranged above the compartments and/or outer packagings 03 after the erecting.

Each holding device 55 assigned to a carrier 51 comprises at least one actuator 56 per each set of compartments and/or each outer packaging 03 erected by means of the carrier 51. The actuator or actuators 56 are preferably arranged at a bar 57 running in parallel to the pivoting axis and particularly preferentially arranged adjustable along the bar 57. The arrangement being adjustable along the bar 57 allows adapting the positions of the actuators 56 along the bar 57 to different dimensions of the compartments and/or outer packagings 03.

The bar 57 can be arranged at least one cantilever arm 58, which holds the bar 57 in a required or desired relative position in relation to the carrier 51. In the instance of a plurality of cantilever arms 58 being provided, they can form a truss structure of a stability that is increased in relation to an individual cantilever arm 58.

Each actuator 56 can have at least one pin 59, which is pneumatically or electromagnetically extractable and retractable again, and which, after the erecting of compartments and/or outer packagings 03, is insertable into respectively one set of compartments and/or one outer packaging 03 and thus prevents the set of compartments and/or the outer packaging 03 from entirely or partly collapsing again to a collapsed or folded cardboard packaging 02 even after a force providing for the expanding has been removed. When the set of compartments and/or the outer packaging 03 is expanded and erected, the pin 59 can be retracted again such that it withdraws again from the set of compartments and/or from the outer packaging 03. In an upright position with the carrier 51 being swung down about the pivoting axis 13, the influence of gravity, which promotes a re-collapsing of the expanded set of compartments and/or of the expanded outer packaging 03, is nullified because the erecting causes the direction of the effect of gravity on the expanded compartments and/or on the expanded outer packaging 03 to change. In this manner, the risk of re-collapsing is averted, and the holding device 55 has fulfilled its task.

Alternatively or additionally, a device 54 designed as previously described as at least one folding flap, for example, can secure the expanded compartments and/or outer packagings 03 in an expanded state at the same time as preventing them from slipping off the carrier 51 after being released.

The cardboard packaging supply 04 can comprise an uprightly standing magazine 42 accommodating one or more stacks 41, which magazine 42 is accessible from its top side for removing cardboard packagings 02.

If a plurality of stacks 41 are accommodated in the magazine 42, as is the case for the apparatus 01 illustrated in FIG. 1 to FIG. 14, they are preferentially at least partly separated from each other by magazine partition walls 43 and/or accommodated in the magazine 42 spaced apart such as will exclude any contact of the individual cardboard packagings 02 of adjacent stacks 41 in the magazine 42. In this way, the topmost cardboard packagings 02 simultaneously removed from a plurality of stacks 41 of the supply 04 of cardboard packagings 02 are prevented from getting caught, thus increasing the operating safety of the apparatus 01.

As for the apparatus 01 illustrated in FIG. 1 to FIG. 14, the cardboard packaging supply 04 can have two or more stacks 41 of flatly collapsed cardboard packagings 02 arranged lying stacked on top of each other, which stacks 41 are adjacent next to each other as seen in a horizontal direction in parallel to the pivoting axis 13 of the at least one carrier 51 of the erecting device 05.

The gripping device 06 here has a plurality of tools 61 arranged next to each other as seen in parallel to the pivoting axis of the at least one carrier 51 of the erecting device 05 for simultaneously seizing the respectively topmost cardboard packaging 02 one after another from each of the stacks 41 adjacent next to each other as seen in parallel to the pivoting axis 13 of the at least one carrier 51 of the erecting device 05. Likewise, the erecting device 05 here correspondingly has a plurality of tools 52 arranged next to each other as seen in parallel to the pivoting axis of the at least one carrier 51 of the erecting device 05 for the compartments and/or outer packagings 03 to be expanded and erected next to each other as seen in parallel to the pivoting axis 13 of the at least one carrier 51 of the erecting device 05 from the then simultaneously seized cardboard packagings 02.

The cardboard packagings 02, which are adjacent to each other as seen along the pivoting axis 13 and which are to be simultaneously expanded and erected to compartments and/or outer packagings 03, can be arranged aligned or offset to each other prior to the expanding. Alternatively or additionally, the cardboard packagings 02, which are adjacent to each other as seen along the pivoting axis 13 and which are to be simultaneously expanded and erected to compartments and/or outer packagings 03, can be arranged twisted relative to each other by 90 degrees, 180 degrees, 270 degrees, for example, and/or mirror-invertedly to a mirror axis or a mirror point prior to the expanding.

The simultaneously expanded and erected compartments and/or outer packagings 03, which are adjacent to each other as seen along the pivoting axis 13, can be arranged aligned or offset to each other after the expanding. Alternatively or additionally, the simultaneously expanded and erected compartments and/or outer packagings 03, which are adjacent to each other as seen along the pivoting axis 13, can be arranged twisted relative to each other by 90 degrees, 180 degrees, 270 degrees, for example, and/or mirror-invertedly to a mirror axis or a mirror point after the expanding.

Alternatively or additionally—as for the apparatus 01 illustrated in FIG. 1 to FIG. 14—it can be provided for an apparatus 01 for expanding and erecting collapsed or folded cardboard packagings 02 to standing compartments and/or outer packagings 03 that the erecting device 05 has at least two carriers 51, which are rotatable from a horizontal position to a vertical position and vice versa respectively about an own pivoting axis with tools 52 arranged at the carriers 51 for seizing and holding, per carrier 51 in its horizontal position, at least one cardboard packaging 02 having been brought onto the erecting device 05 by means of the gripping device 06 at a cardboard packaging wall 22 of its bottom flat side 24. In this connection:

the pivoting axes 13 of the carriers 51 run in parallel, the cardboard packaging supply 04 has a number of adjacent stacks 41, as seen in a horizontal direction orthogonal to the pivoting axes 13, of flatly collapsed cardboard packagings 02 arranged lying on top of each other, the number of stacks 41 corresponding to the number of carriers 51 that are respectively rotatable about their own pivoting axes 13, and the gripping device 06 for the simultaneous seizing of one respectively topmost cardboard packaging 02 after the other from each of the stacks 41, which are adjacent next to each other as seen orthogonal to the pivoting axes 13 of the at least two carriers 51 of the erecting device 05, correspondingly has a plurality of tools 61, which are arranged next to each other as seen orthogonal to the pivoting axes 13 of the at least two carriers 13 of the erecting device 05, for the compartments and/or outer packagings 03 then to be simultaneously expanded and erected, from the seized cardboard packagings 02, next to each other as seen orthogonal to the pivoting axes 13 of the at least two carriers 51 of the erecting device 05.

The cardboard packagings 02, which are adjacent to each other as seen orthogonal to the pivoting axes 13 and which are to be simultaneously expanded and erected to compartments and/or outer packagings 03, can be arranged aligned or offset to each other prior to the expanding. Alternatively or additionally, the cardboard packagings 02, which are adjacent to each other as seen orthogonal to the pivoting axes 13 and which are to be simultaneously expanded and erected to compartments and/or outer packagings 03, can be arranged twisted relative to each other by 90 degrees, 180 degrees, 270 degrees, for example, and/or mirror-invertedly to a mirror axis or a mirror point prior to the expanding.

The simultaneously expanded and erected compartments and/or outer packagings 03, which are adjacent to each other as seen orthogonal to the pivoting axes 13, can be arranged aligned or offset to each other after the expanding. Alternatively or additionally, the simultaneously expanded and erected compartments and/or outer packagings 03, which are adjacent to each other as seen orthogonal to the pivoting axes 13, can be arranged twisted relative to each other by 90 degrees, 180 degrees, 270 degrees, for example, and/or mirror-invertedly to a mirror axis or a mirror point after the expanding.

Particularly preferentially, the apparatus 01, as illustrated in FIG. 1 to FIG. 14, is equipped with an erecting device 05 having two carriers 51, which are rotatable in opposite directions from a horizontal position to a vertical position and vice versa respectively about an own pivoting axis 13. As seen in a horizontal direction orthogonal to the pivoting axes 13, the cardboard packaging supply 04 of such an apparatus 01 has two adjacent stacks 41 of flatly collapsed cardboard packagings 02 arranged lying on top of each other. The lying, stacked cardboard packagings of a first stack of the two stacks, which are adjacent next to each other as seen in a horizontal direction orthogonal to the pivoting axes, are preferentially stacked, as seen in relation to a mirror axis running in parallel to the pivoting axes between the two stacks, mirror-invertedly with respect to the also lying cardboard packagings of a second stack of the two stacks, which are adjacent as seen in a horizontal direction orthogonal to the pivoting axes.

Here, the pivoting axes 13 of the carriers 51 also run in parallel.

The at least two carriers 51 of the erecting device 05 can be movably arranged in a horizontal direction such that they can be moved apart from each other during their preferably simultaneous rotating about their pivoting axes 13 in order to prevent a clashing of expanded compartments and/or outer packagings 03 during the rotating and/or such that they can be moved toward each other and/or in parallel to each other after reaching the vertical position, thus enabling a grouping of the expanded and erected compartments and/or outer packagings 03. An adaptation to compartments and/or outer packagings 03 with different external dimensions is thus moreover possible.

As at least one tool 61 per each simultaneously seized cardboard packaging 02, the gripping device 06 can have at least one downwardly directed suction cup 64, which, by impingement with a vacuum, is able to hold a cardboard packaging 02 lying respectively topmost on a stack 41 of the cardboard packaging supply 04 at one of the cardboard packaging walls 22 of its top flat side 23 by means of the vacuum.

A suction cup 64 has a downwardly open sleeve of an elastic, airtight material as well as a connection leading upward and away from the sleeve for a vacuum source, such as, for instance, a vacuum pump or a negative pressure pump, or a vacuum accumulator connected with a vacuum pump or a negative pressure pump. Preferably, a control opening and closing valve is arranged between each suction cup assigned to a cardboard packaging and the vacuum source. The vacuum source communicates with the suction cup when the valve is opened. In the instance of the downwardly open sleeve not being covered, air flows through the suction cup to the vacuum source, which, strictly speaking, thus represents a drain for the air that is under ambient pressure. In the instance of the downwardly open sleeve being blocked by a cardboard packaging wall, a vacuum forms in the suction cup, and the cardboard packaging wall together with the associated cardboard packaging are held.

Preferably, the gripping device 06 has at least four downwardly directed suction cups 64 as tool per each simultaneously seized cardboard packaging 02, which suction cups 64 can hold a cardboard packaging 02 lying respectively topmost on a stack 41 in the area of the corners of one of the cardboard packaging walls 22 of its top flat side 23 by means of the vacuum. In comparison to only one suction cup 64 per each simultaneously seized cardboard packaging 02, this has the advantage of greater redundancy and, at the same time, a greater holding force, which is required for expanding the folded cardboard packagings 02 to initially lying compartments and/or outer packagings 03, which are than erected to a standing position by means of the erecting device 05 by rotating its at least one carrier 51 about its pivoting axis 13 after the expanding.

In this context, the at least one suction cup 64, which is provided per stack 41 of the cardboard packaging supply 04, is arranged at the manipulator head 63 of the at least one manipulator 62 of the gripping device 06, whereby the suction cup 64—in the instance of the manipulator head 63 being movable not only horizontally, but also vertically—can be lowered onto the cardboard packaging supply 04, lifted back up again with a suction-held cardboard packaging 02, be laterally traversed to the erecting device 05 and lowered onto it and lifted back up again as well as traversed back to the cardboard packaging supply 04 after the release of the cardboard packaging 02, which has then been expanded to a set of compartments and/or to an outer packaging 03.

The at least one tool 52 of the erecting device 05 can, alternatively or additionally to the design of the at least one tool 61 of the gripping device 06, also be one or more suction cups 53.

Preferably, the erecting device 05 has at least four suction cups 53 as tool 52 per each simultaneously seized cardboard packaging 02, which suction cups 53 are upwardly directed in the horizontal position of their at least one carrier 51, and which suction cups 53 can hold a cardboard packaging 02 having been brought onto it by means of the gripping device 06 in the area of the corners of one of the cardboard packaging walls 22 of its bottom flat side 24 by means of the vacuum. In comparison to the use of only one suction cup 63 per each simultaneously seized cardboard packaging 02, this has the advantage of greater redundancy and, at the same time, a greater holding force, which is required for expanding the folded cardboard packagings 02 to initially lying compartments and/or outer packagings 03, which are than erected to a standing position by means of the erecting device 05 by rotating its at least one carrier 51 about its pivoting axis 13 after the expanding.

The apparatus 01 can comprise a control device, which at least:

controls the at least one manipulator 62 of the gripping device 06 such that it carries out a cyclical movement path, in the course of which the manipulator head 63 traverses in parallel to the horizontal axis 11 from above the cardboard packaging supply 04 over the erecting device 05 and back again, controls the gripping device 06 and/or the erecting device 05 such that they carry out a recurring movement path relative to each other as seen in direction of the vertical axis 12, in the course of which movement path the distance between the tools 61, 52 of the gripping device 06 and the erecting device 05 is increased at least so far that a cardboard packaging 02 being held between the tools 61, 52 of the gripping device 06 and the erecting device 05 is expanded to a lying set of compartments and/or to an outer packaging 03, and in the further course of which movement path the vertical distance between the tools 61, 52 of the gripping device 06 and the erecting device 05 is again reduced to at least a thickness dimension measured normal to the top and bottom flat sides 23, 24 of a lying, flatly collapsed cardboard packaging 02, controls the at least one tool 61 of the gripping device 06 such that, when it is located above the at least one stack 41 of the cardboard packaging supply 04, it seizes a cardboard packaging wall 22 of the top flat side 23 of a cardboard packaging 02 lying topmost on at least one stack 41 of the cardboard packaging supply 04 and holds it for as long as until it is located above the erecting device 05 and the distance between the tools 61, 52 of the gripping device 06 and the erecting device 05 has been increased at least so far that the cardboard packaging 02 is expanded to a lying set of compartments and/or to an outer packaging 03 in the course of the recurring movement path of the gripping device 06 and the erecting device 05, controls the at least one carrier 51 of the erecting device 05 such that it carries out a cyclical rotating movement path, in the course of which it is rotated about its pivoting axis by 90 degrees from its horizontal position into its vertical position and back again, wherein the carrier 51 takes up a horizontal position at the latest when the at least one manipulator head 63 is located, during its course of movement along the horizontal axis 11, above the erecting device 05, and maintains the horizontal position for as long as until the distance between the tools 61, 52 of the gripping device 06 and the erecting device 05 has been increased at least so far that a cardboard packaging 02 being held by the tools 61, 52 of the gripping device 06 and the erecting device 05 is expanded to a lying set of compartments and/or to an outer packaging 03 in the course of the recurring movement path of the gripping device 06 and the erecting device 05, in order to hereafter take up a vertical position by swinging down and/or rotating about its pivoting axis 13, and controls the at least one tool 52 of the erecting device 05 such that, as soon as the manipulator head 63 with the at least one cardboard packaging having been seized and being held by the at least one tool 61 arranged at the manipulator head 63 is located above the erecting device 05, the tool 52 seizes a cardboard packaging wall 22 of the bottom flat side 23 of the at least one cardboard packaging 02 being held by the at least one tool 61 of the gripping device and holds it at least for as long as until the cardboard packaging 02, which was expanded to a set of compartments and/or an outer packaging 03 by a vertical distance increase between the tools 61, 52 of the gripping device 06 and the erecting device 05, has been erected by swinging down and/or rotating the at least one carrier 51 of the erecting device 05 by 90 degrees about its pivoting axis 13 from the horizontal position to the vertical position, and the cardboard packaging 02 is available for its further use, for instance, for transfer to a transfer device 07.

For instance, in connection with a manipulator head 63, which is not only movable horizontally, but also vertically, the apparatus 01 can comprise a control device, which at least:

controls the at least one manipulator 62 of the gripping device 06, which manipulator 62 is also mentioned as representative of its manipulator head 63 in the following, such that it carries out a cyclical movement path, in the course of which the manipulator 06 lowers the at least one tool 61 of the gripping device 06 onto a cardboard packaging wall 22 of the top flat side 23 of a cardboard packaging 02 lying topmost on at least one stack 41 of the cardboard packaging supply 04, lifts it up again, traverses to the erecting device 05, lowers it onto the erecting device 05 and lifts it back up again and finally traverses over the cardboard packaging supply 04 again, controls the at least one tool 61 of the gripping device 06 such that it, after being lowered, seizes and holds a cardboard packaging wall 22 of the top flat side 23 of a cardboard packaging 02 lying topmost on at least one stack 41 of the cardboard packaging supply 04 until the tool 61 of the gripping device 06, in the course of the cyclical movement path, has been lifted back up again from the erecting device 05 for at least so far that the cardboard packaging 02 is expanded to a set of compartments and/or to an outer packaging 03, controls the at least one carrier 51 of the erecting device such that it carries out a cyclical rotating movement path, in the course of which it is rotated about its pivoting axis 13 by 90 degrees from the horizontal or its horizontal position, as the case may be, to the vertical or its vertical position, as the case may be, and back again, wherein the carrier 51 takes up a horizontal position at the latest when the at least one manipulator 62, during its course of movement, lowers or has lowered the at least one tool 61 of the gripping device 06 onto the erecting device 05 and maintains the horizontal position for as long as until the tool of the gripping device 06, in the course of the cyclical movement path of the manipulator 62, has been lifted back up again from the erecting device 05 for at least so far that the cardboard packaging 02 is expanded to a set of compartments and/or to an outer packaging 03, in order to hereafter take up a vertical position by swinging down and/or rotating about its pivoting axis 13, and controls the at least one tool 52 of the erecting device 05 such that, after lowering the at least one manipulator 62 onto the erecting device 05, the tool 52 seizes a cardboard packaging wall 22 of the bottom flat side 24 of the at least one cardboard packaging 02 being held and having been brought to the erecting device 05 by the at least one tool 61 of the gripping device 05 and holds it at least for as long as until the cardboard packaging 02, which is expanded to a set of compartments and/or to an outer packaging 03, has been erected and is available for its further use by swinging down and/or rotating the at least one carrier 51 of the erecting device 05 by 90 degrees about its pivoting axis 13 from its horizontal position to its vertical position.

In dependence on the configuration of the cardboard packagings 02 and of the compartments and/or outer packagings 03 expandable therefrom, the control device can cause the manipulator 62 or its manipulator head 63, respectively, to carry out a horizontal movement running in parallel and/or orthogonal to the horizontal axis 11 at the same time while the tool 61 of the gripping device 06 is lifted, at the end of which horizontal movement the cardboard packaging wall 22 previously assigned to the top flat side 23 of the cardboard packaging 02 having been seized by at least one tool 61 of the gripping device 06 and the cardboard packaging wall 22 previously assigned to the bottom flat side 24 of a cardboard packaging 02 having been seized by at least one tool 52 of the erecting device 05 are arranged superposed upon each other as seen from a top view in a horizontal direction along the vertical axis 12, corresponding to two opposite walls of an expanded set of compartments and/or an outer packaging 03.

Preferably, however, the cardboard packagings are configured such that they can be expanded by a mere increase of distance between the tools 61, 52 of the gripping device 06 and the erecting device 05. This is possible, for instance, by way of an accordion-like structure with an even number of cardboard packaging walls 22 connecting the cardboard packaging walls 22 being held by the tools 61, 52 at respectively one of their narrow sides in the area of, for instance, a bending edge 21 with each other, as this is illustrated in FIG. 15 using the example of a cardboard packaging 02 with respectively two cardboard packaging walls 22 forming a top flat side 23 and a bottom flat side 24 as well as respectively one further cardboard packaging wall 22 connecting the top flat side 23 with the bottom flat side 24. In the instance of such a cardboard packaging 02, the two cardboard packaging walls 22, which are lying on top of each other, however, are not immediately connected with each other at a common bending edge 21 in the folded state, are seized by the tools 61, 52 of the gripping device 06 and the erecting device 05 and can be expanded in a direction running exclusively along the vertical axis 12 standing normal upon the surfaces of the cardboard packaging walls 22 seized by the tools.

In dependence on the design of the cardboard packaging 02, the lifting following the lowering onto the erecting device 05 can thus be carried out exclusively in a vertical direction.

In order to achieve an as high as possible pacing, the control device can cause combined relative movements between the gripping device 06 and the erecting device 05 in a horizontal and a vertical direction before and after the erecting of cardboard packagings 02 to compartments and/or outer packagings 03.

The apparatus 01 can comprise an already mentioned transfer device 07, for instance, which is also controlled by a control device, and which receives expanded and erected compartments and/or outer packagings 03 from the erecting device 05, preferentially from the vertical position of the carrier 51 of the erecting device 05, and supplies them to their further use, for instance, by subsequent inserting of expanded and erected compartments into outer packagings staged elsewhere and/or by the placing of articles into compartments and/or outer packagings 03.

The transfer device 07 can comprise at least one tool 73 arranged at a head 71 of a transfer device manipulator 72, which tool 73 receives expanded and erected compartments and/or outer packagings 03 from the erecting device 05, for instance, by dipping into the access openings 31 of the compartments and/or outer packagings 03, which access openings 31 are located in a horizontal plane after the erecting, and seizing the compartments and/or outer packagings 03 from inside, for instance, by lateral pressure, and discharging them by way of a vertical and/or horizontal movement of the head 71 of the transfer device manipulator 72.

Alternatively, the compartments and/or outer packagings 03, which are erected to a standing position after the rotating of the at least one carrier 51 of the erecting device 05, can also be released by simply disengaging the at least one tool 52 of the erecting device 05 and thus be transferred, for instance, to a horizontal conveyor passing immediately below the erecting device 05. In this instance, the vertical distance between such a horizontal conveyor and the erecting device 05 can be adjusted such that the compartments and/or outer packagings 03, which are erected to a standing position after the rotating of the at least one carrier 51 about its pivoting axis 13 from its horizontal position to its vertical position, take up an as small as possible distance to the surface of the horizontal conveyor, for instance, grazing the surface. Furthermore conceivable is a set down movement of the erecting device 05 in a vertical direction prior to the release.

Preferentially, the erecting device 05 as well as the surface of the cardboard packaging supply 04 formed by the topmost cardboard packaging 02 of the at least one stack 41 of cardboard packagings 02 are located at least approximately at the same level, at least in a starting position.

Particularly preferentially, however, the surface of the cardboard packaging supply 04 formed by the topmost cardboard packaging 02 of the at least one stack 41 is located at a level that is higher by at least the height of a lying, expanded set of compartments and/or of a lying, expanded outer packaging 03 than a level of the erecting device 05 formed by the at least one tool 52 of the erecting device 05 in the horizontal position of its at least one carrier 51 during the seizing of a cardboard packaging wall 22 of the bottom flat side 24 of a cardboard packaging 02. In this way, a vertical stroke, for instance, of the manipulator head 63 in a return movement of the manipulator head 63 from the erecting device 05 to the cardboard packaging supply 04, which is required for seizing the next cardboard packagings 02 after expanding a cardboard packaging to a lying set of compartments and/or to an outer packaging 03, is not needed, thus increasing the achievable pacing.

The mentioned horizontal and vertical axes 11, 12 are geometric axes, whereas the mentioned pivoting axis or pivoting axes 13 can also be machine axes.

The apparatus allows carrying out a method for expanding and erecting collapsed or folded cardboard packagings 02 to standing compartments and/or outer packagings 03 in a recurring sequence as illustrated in the FIG. 1 to FIG. 14.

Figure 12:
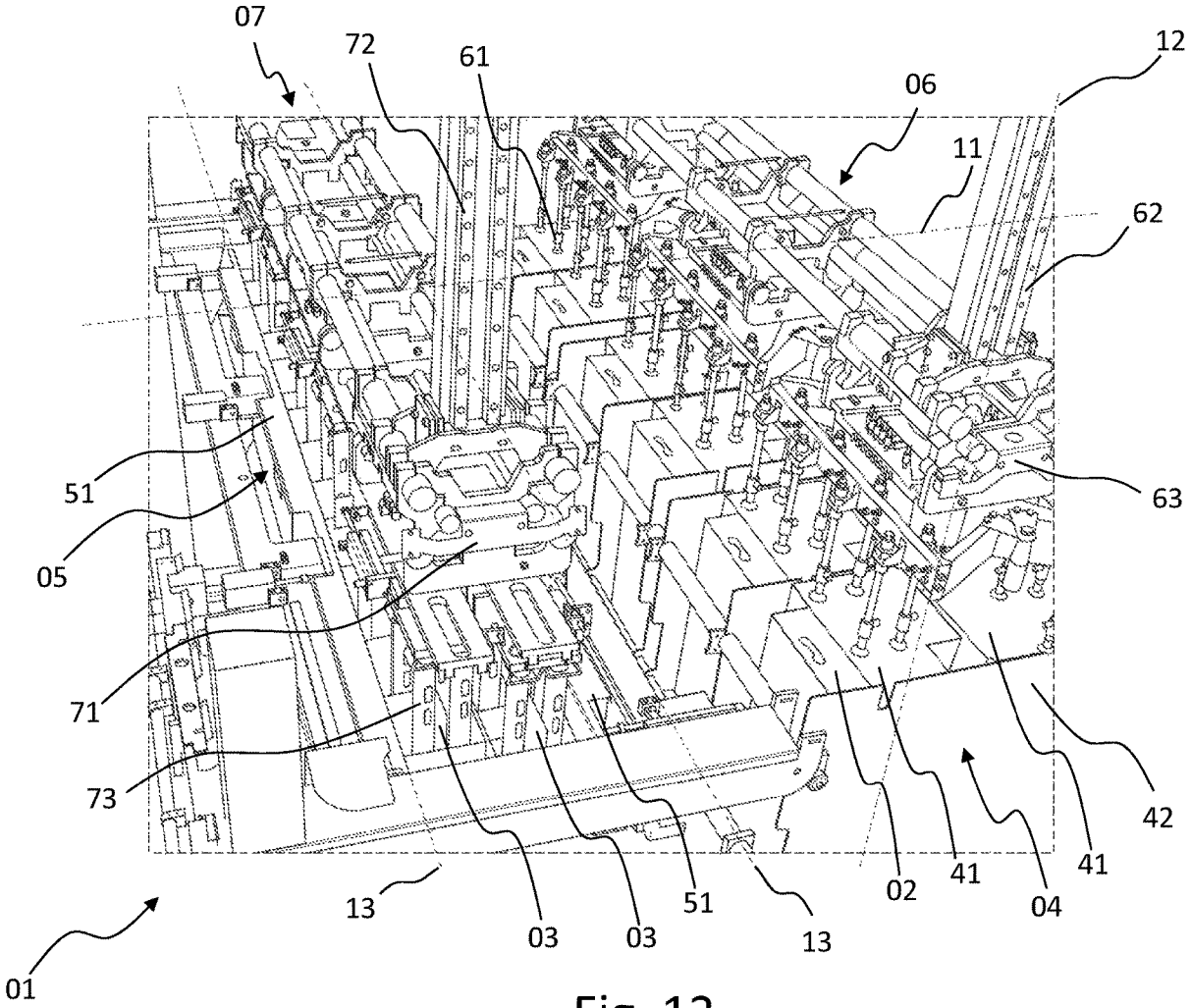
FIG. 12 shows a perspective view of a snapshot illustration temporally immediately following the snapshot illustration in FIG. 11.
Figure 13:
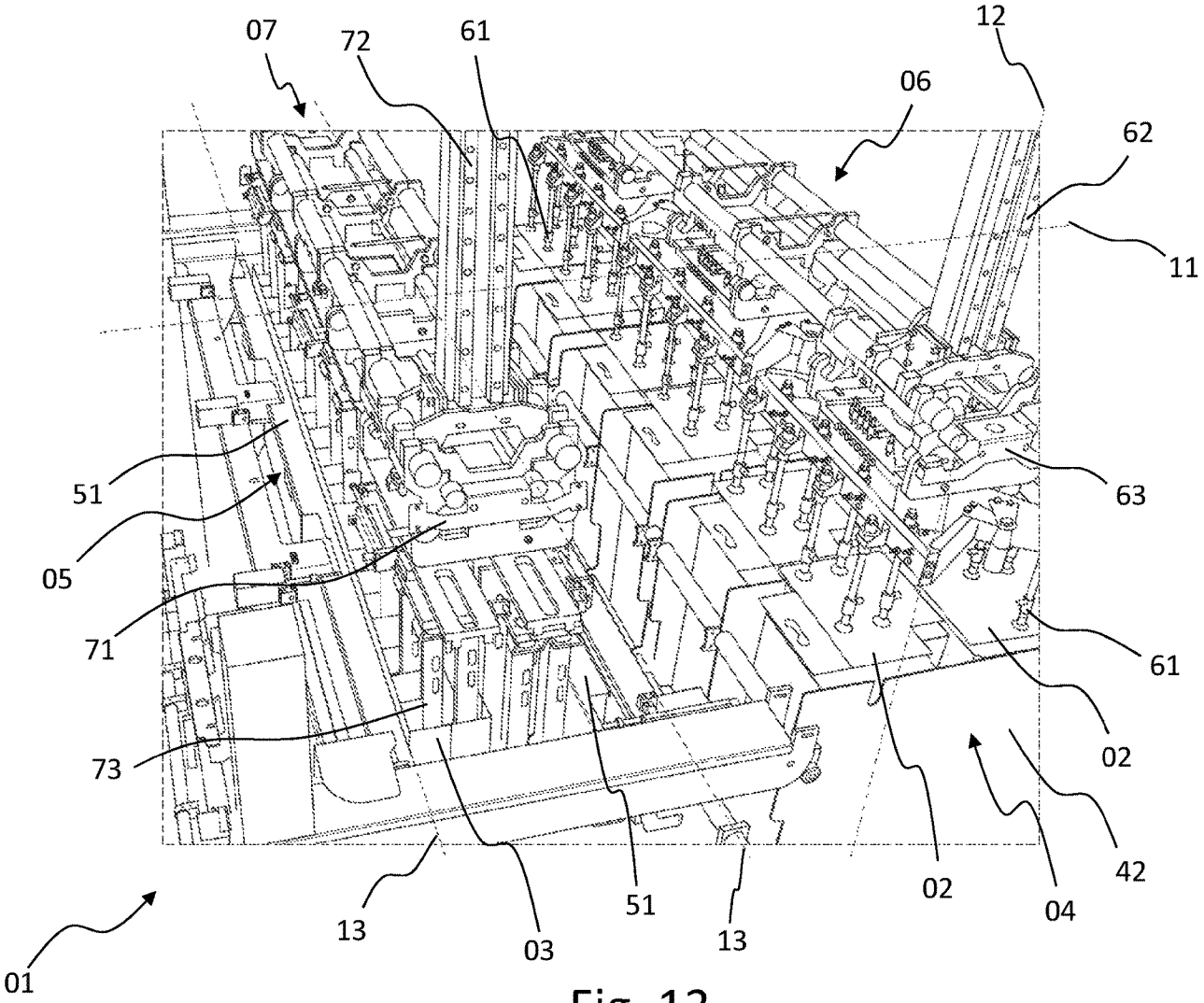
FIG. 13 shows a perspective view of a snapshot illustration temporally immediately following the snapshot illustration in FIG. 12.
Figure 14:
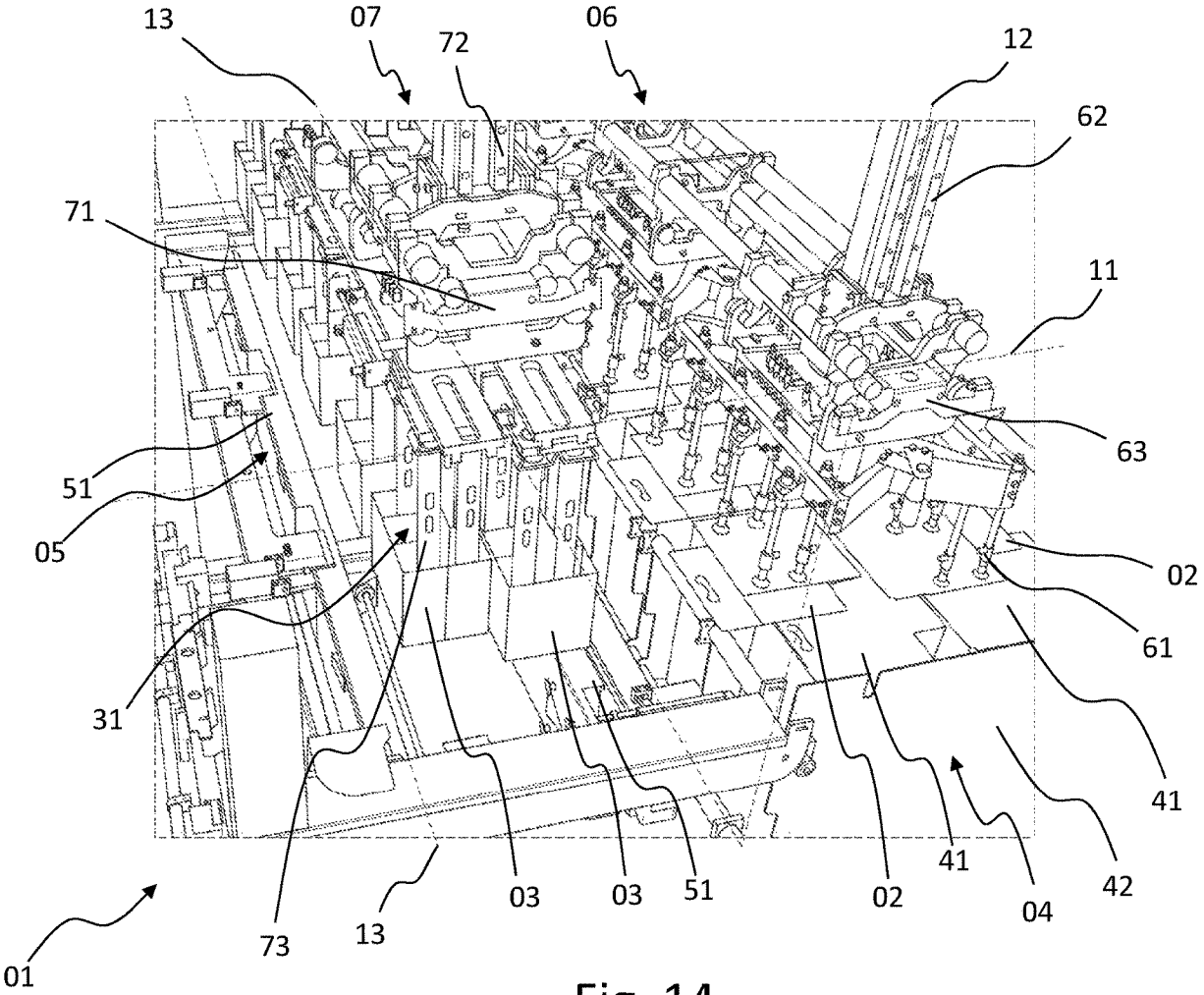
FIG. 14 shows a perspective view of a snapshot illustration temporally immediately following the snapshot illustration in FIG. 13.

Starting in FIG. 12, the method provides to hold the topmost cardboard packaging 02, coming from above, at a cardboard packaging wall 22 of its top flat side 23 from a stack 41 of flatly collapsed cardboard packagings 02 arranged on top of each other of a supply of cardboard packagings 02, and to remove it from the stack 41, for instance, in movement shown by the sequence of the FIG. 13, FIG. 14, FIG. 1, FIG. 2, FIG. 3.

Figure 1:
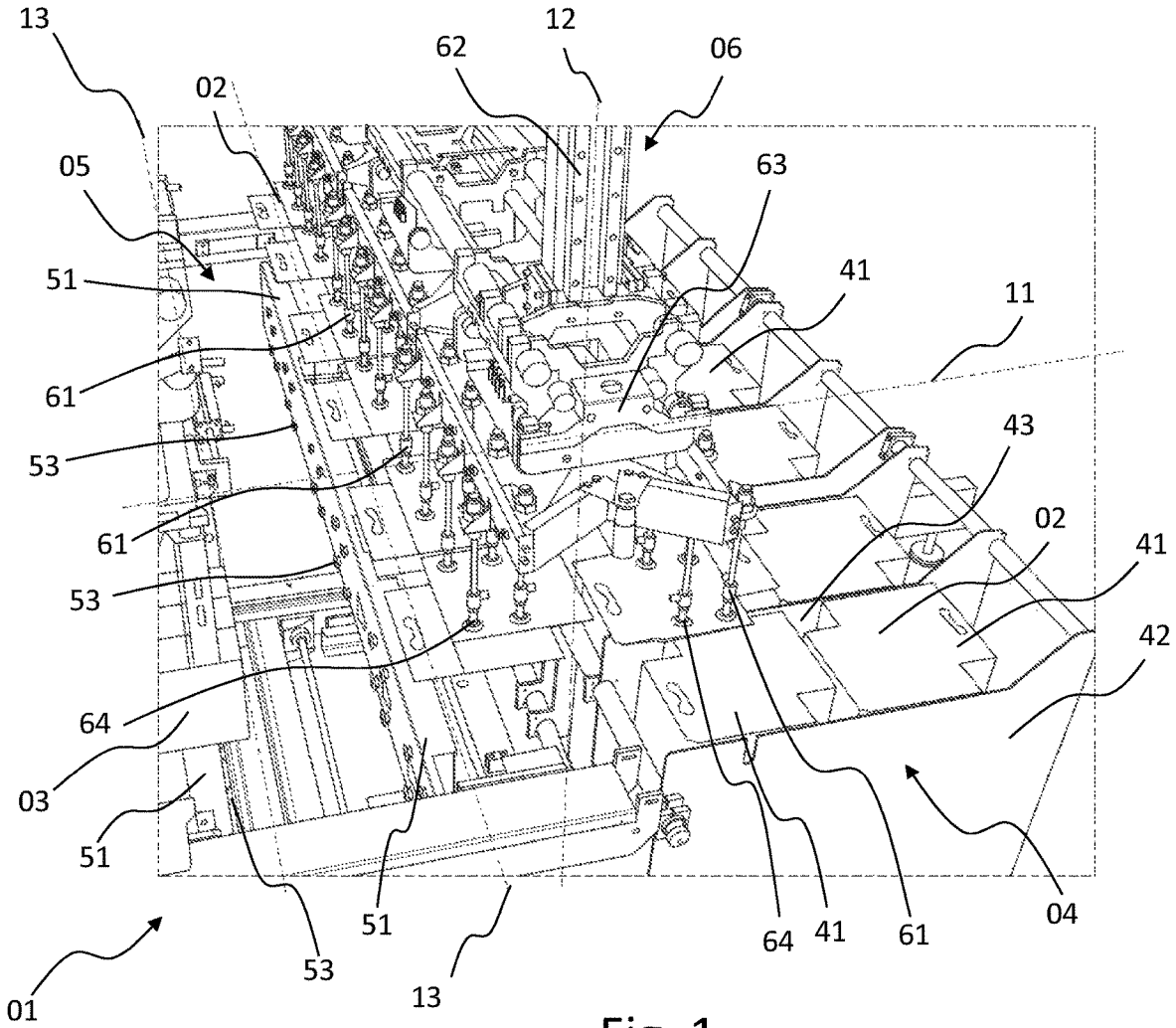
FIG. 1 shows a perspective view of a snapshot illustration recurring after the snapshot illustration in FIG. 14 of an apparatus according to the invention for expanding and erecting collapsed or folded cardboard packagings to standing compartments and/or outer packagings, the apparatus carrying out a method according to the invention for expanding and erecting collapsed or folded cardboard packagings to standing compartments and/or outer packagings.
Figure 2:
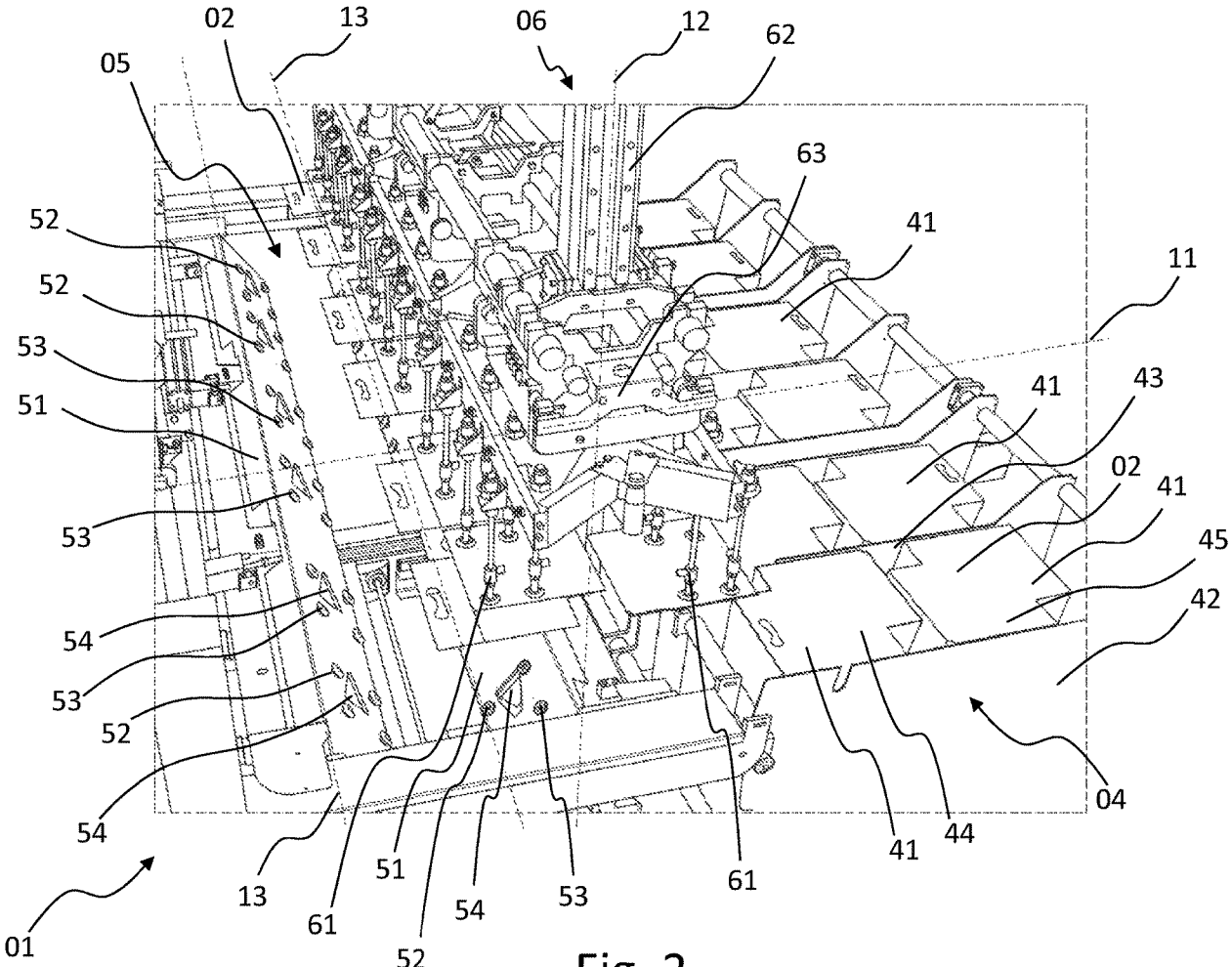
FIG. 2 shows a perspective view of a snapshot illustration temporally immediately following the snapshot illustration in FIG. 1.
Figure 3:
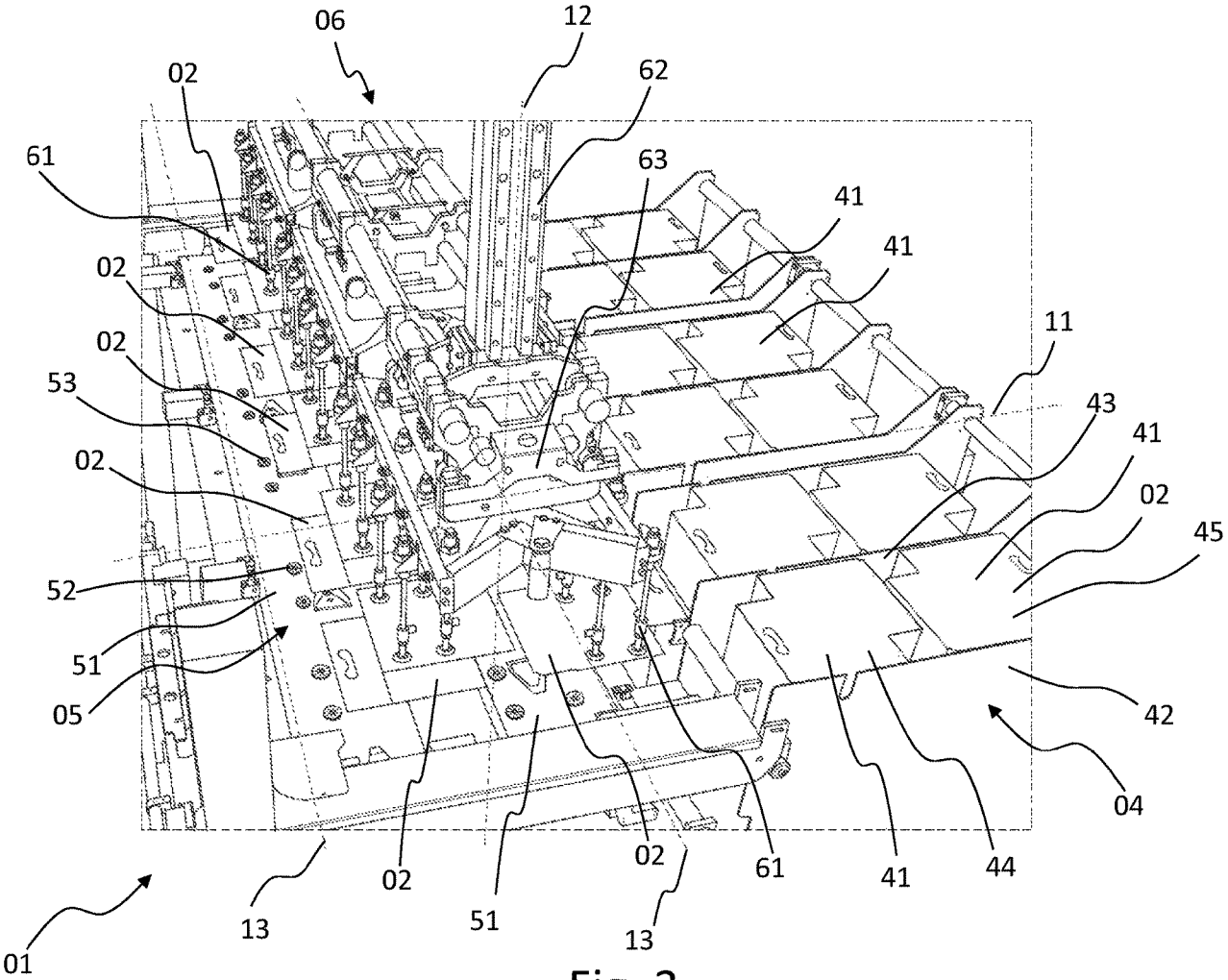
FIG. 3 shows a perspective view of a snapshot illustration temporally immediately following the snapshot illustration in FIG. 2.
Figure 4:
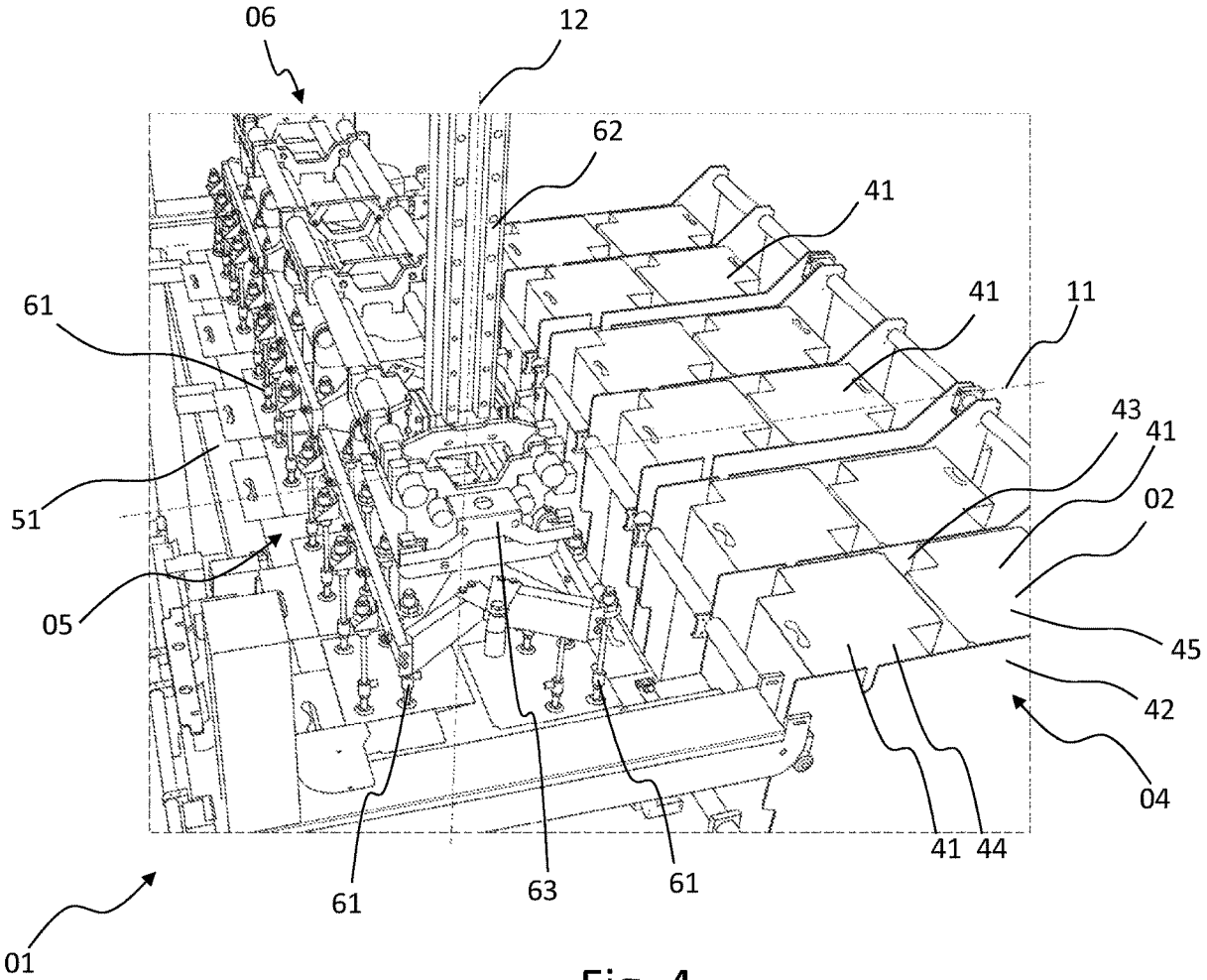
FIG. 4 shows a perspective view of a snapshot illustration temporally immediately following the snapshot illustration in FIG. 3.
Figure 5:
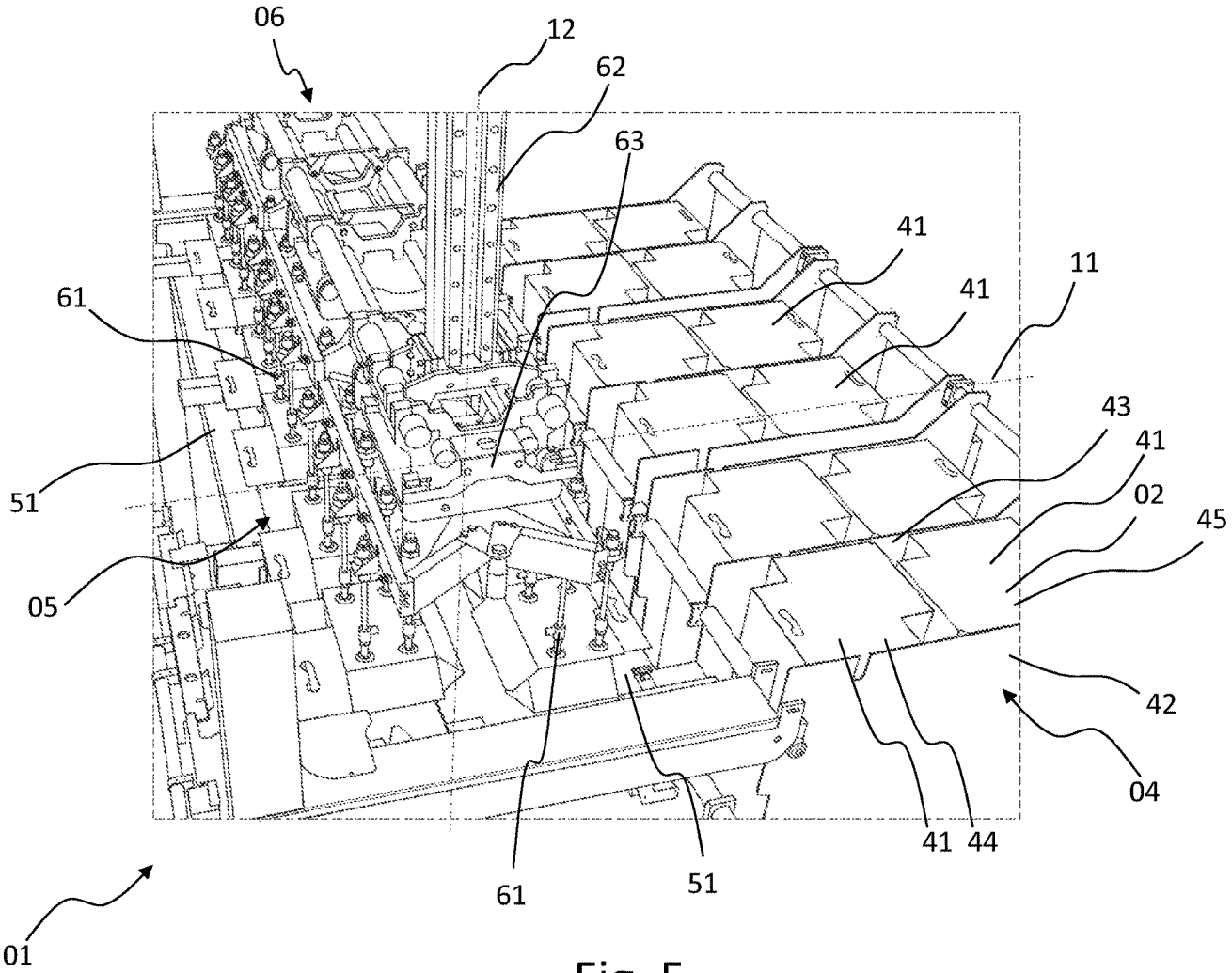
FIG. 5 shows a perspective view of a snapshot illustration temporally immediately following the snapshot illustration in FIG. 4.

The method subsequently provides to also hold the cardboard packaging 02, which is being held at a cardboard packaging wall 22 of its top flat side 23, at a cardboard packaging wall 22 of its bottom flat side 24 from below, as well, as is carried out, for instance, in FIG. 4, and to increase the vertical distance between the cardboard packaging wall 22, at which the cardboard packaging 02 is being held at its top flat side 23, and the cardboard packaging wall 22, at which the cardboard packaging 02 is being held at its bottom flat side 24, by oppositely pulling so far until the cardboard packaging 02 has been expanded to a lying set of compartments and/or to a lying outer packaging 03.

Figure 6:
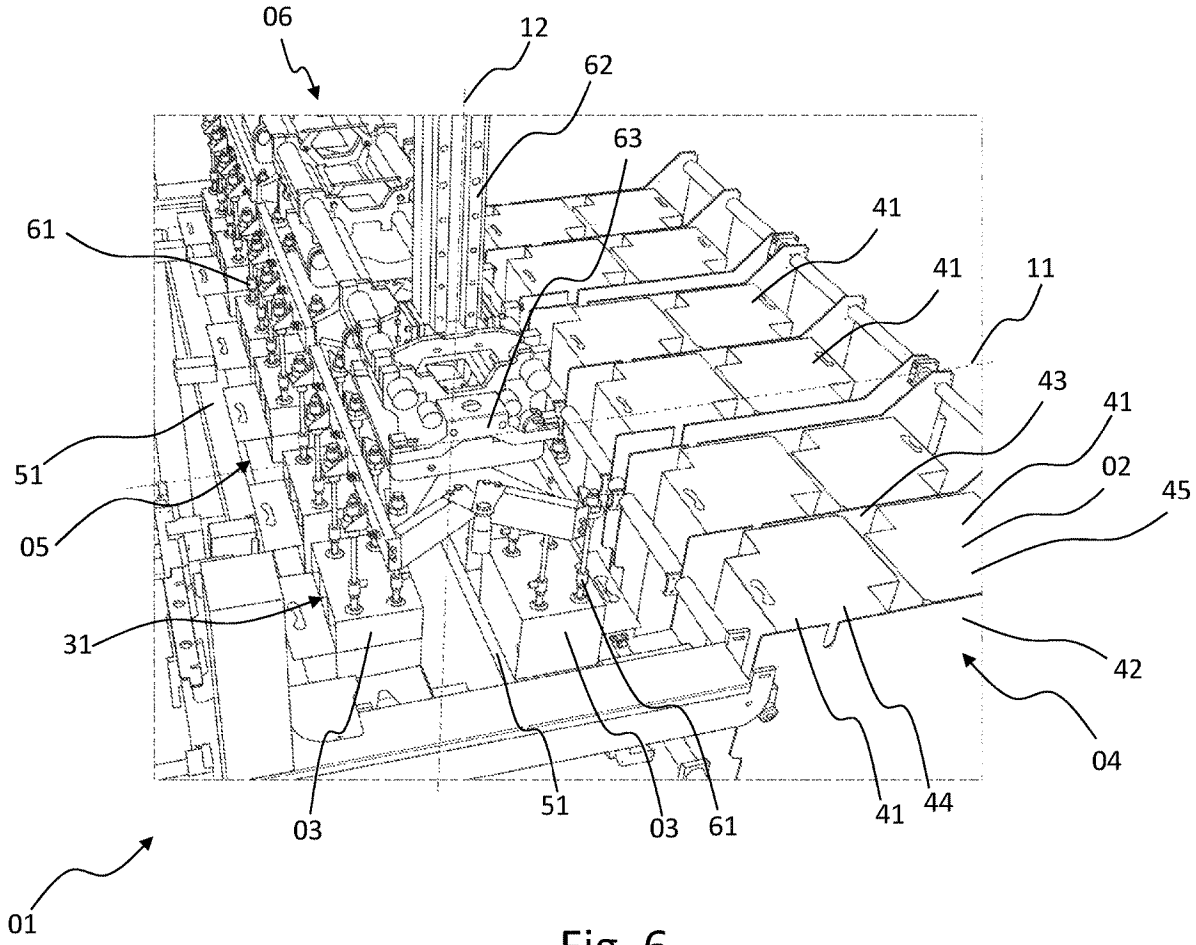
FIG. 6 shows a perspective view of a snapshot illustration temporally immediately following the snapshot illustration in FIG. 5.
Figure 7:
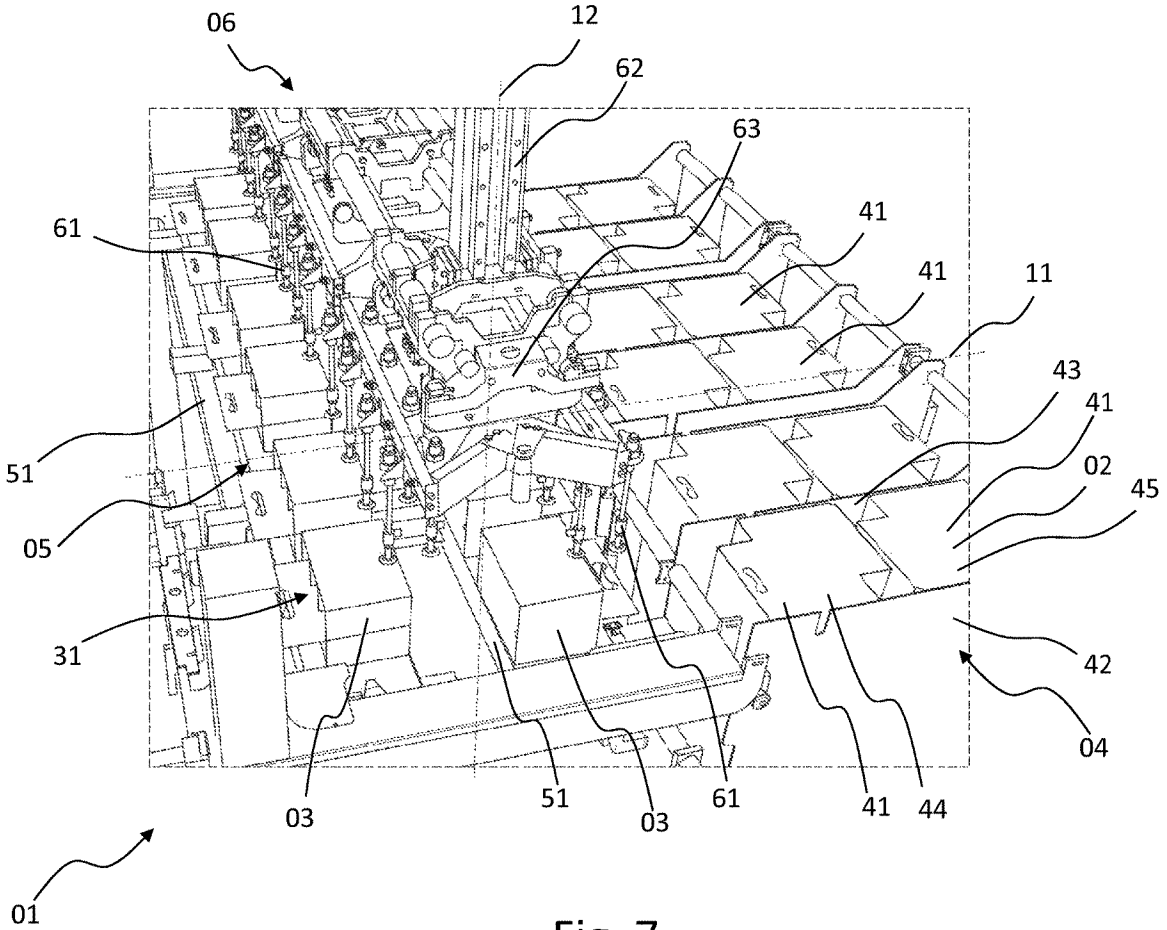
FIG. 7 shows a perspective view of a snapshot illustration temporally immediately following the snapshot illustration in FIG. 6.

The method then provides to release the expanded set of compartments and/or the outer packaging 03 at its cardboard packaging wall 22 that was previously assigned to the top flat side 23 of the cardboard packaging 02, as is exemplarily illustrated in the sequence of FIG. 6 and FIG. 7.

Figure 8:
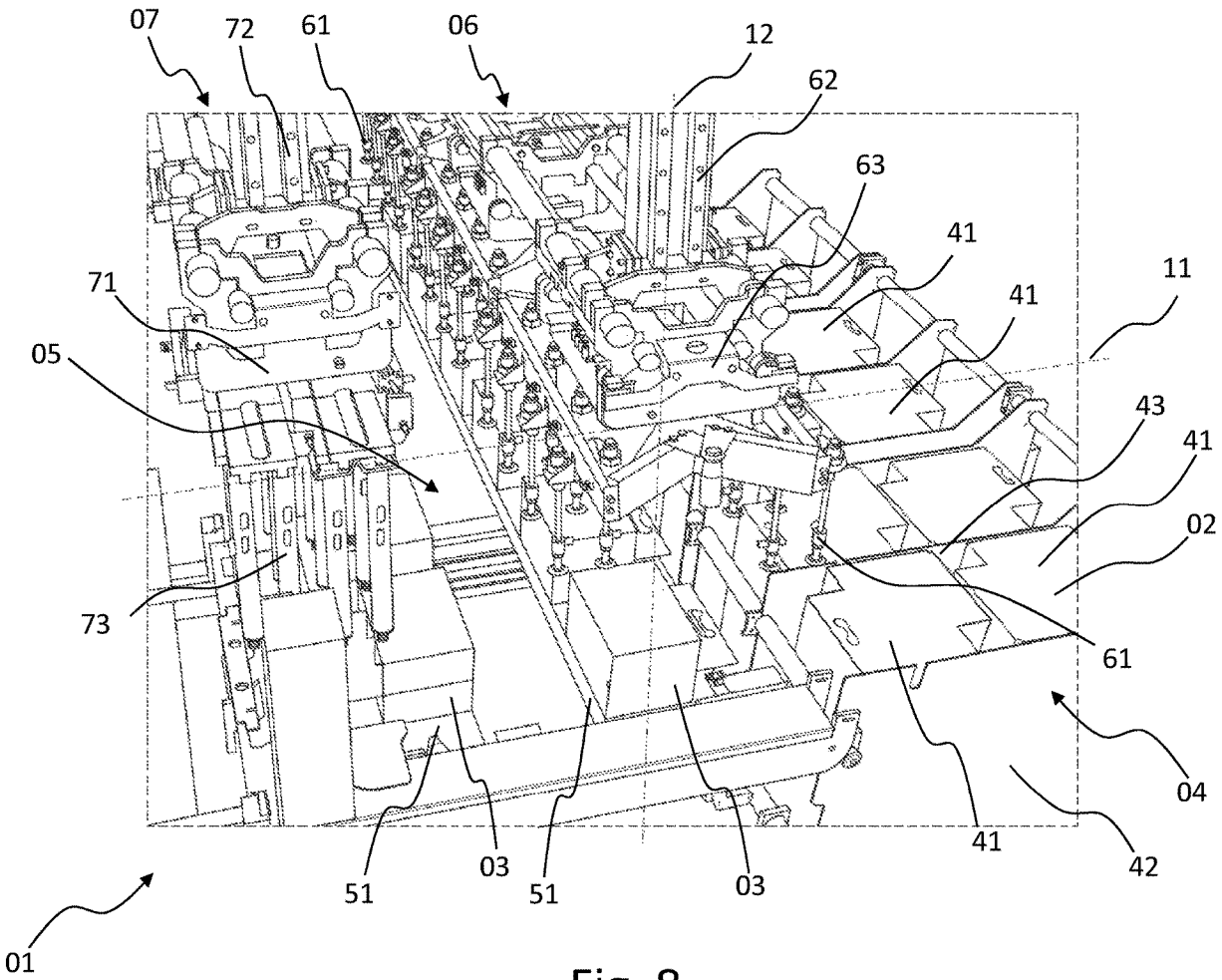
FIG. 8 shows a perspective view of a snapshot illustration temporally immediately following the snapshot illustration in FIG. 7.
Figure 9:
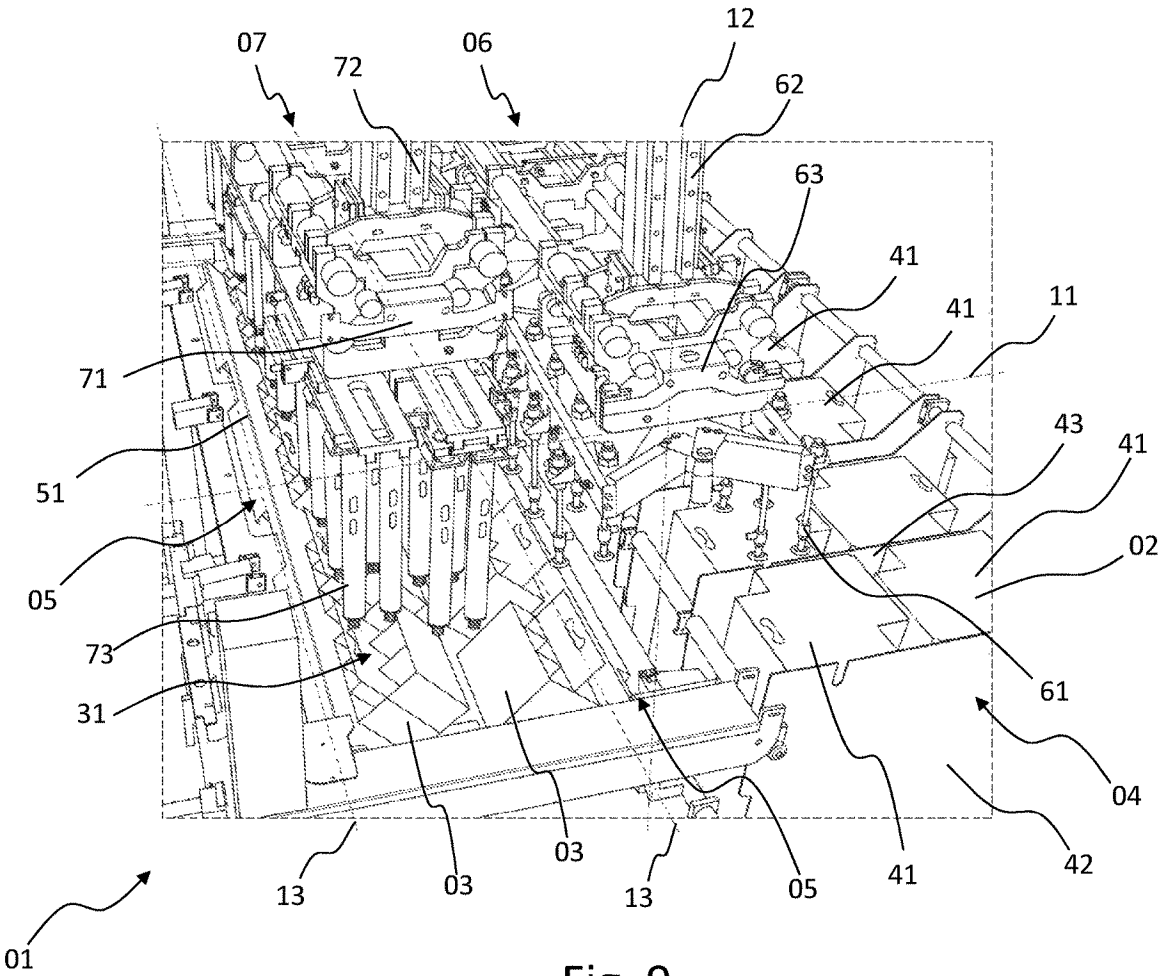
FIG. 9 shows a perspective view of a snapshot illustration temporally immediately following the snapshot illustration in FIG. 8.
Figure 10:
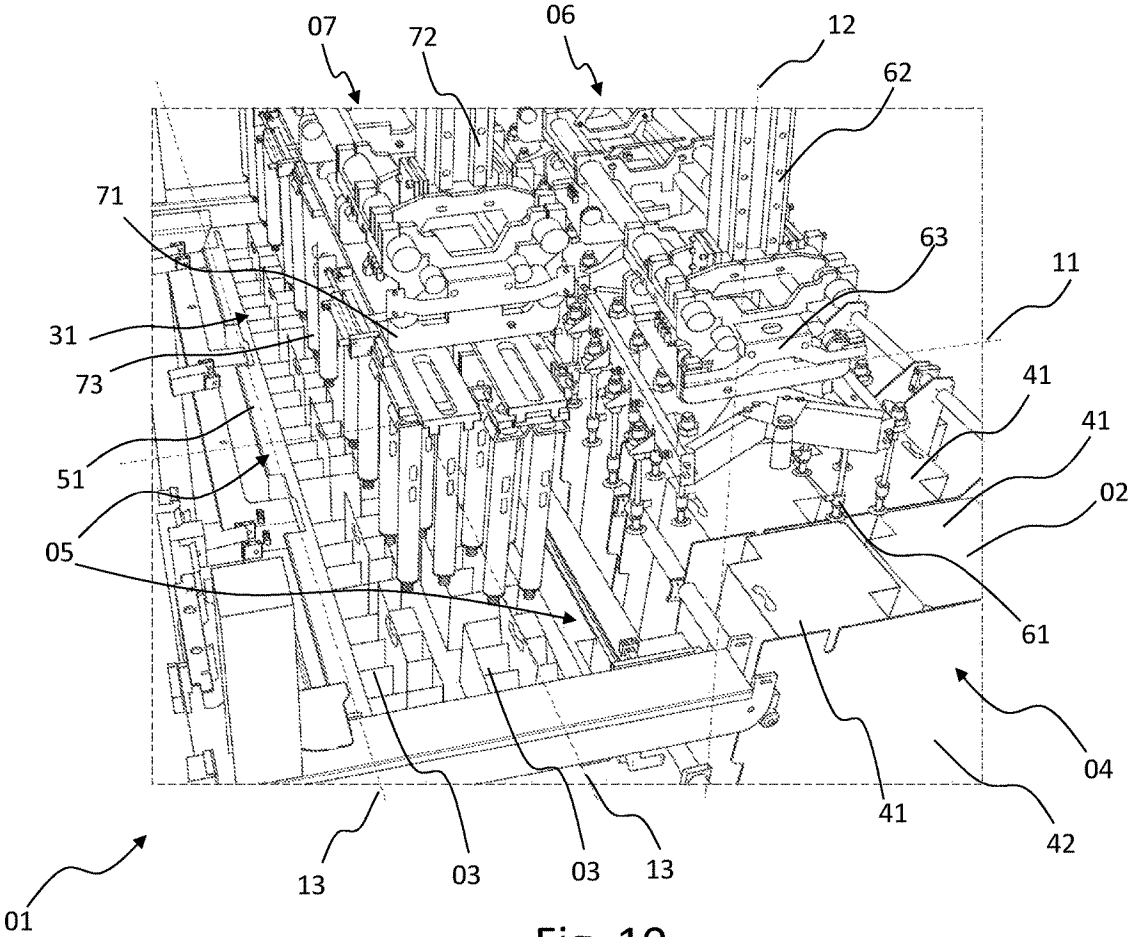
FIG. 10 shows a perspective view of a snapshot illustration temporally immediately following the snapshot illustration in FIG. 9.

The method finally provides to tilt the lying, expanded set of compartments and/or the outer packaging 03 still being held at its cardboard packaging wall 22 that was previously assigned to the bottom flat side 24 of the cardboard packaging 02 about a horizontal pivoting axis 13, as is, for instance, illustrated in the sequence of FIG. 8, FIG. 9, and FIG. 10.

Finally, the method subsequently provides to also release the expanded and now erected set of compartments and/or the outer packaging 03 at its cardboard packaging wall 22 that was previously assigned to the bottom flat side 24 of the cardboard packaging 02 to a discharge for the further use, as is, for instance, illustrated in the sequence of the FIG. 11, FIG. 12, FIG. 13, FIG. 14, and FIG. 1.

The method preferably provides to simultaneously expand and erect a plurality of cardboard packagings 02 to compartments and/or outer packagings 03 in the manner described.

In this case, respectively two cardboard packagings 02 can form a pair of cardboard packagings 02 to be simultaneously expanded and erected to compartments and/or outer packagings 03, which, after having been expanded to lying compartments and/or outer packagings 03, are erected to standing compartments and/or outer packagings 03 in the same or the opposite rotating direction about respectively own horizontal pivoting axes 13 running in parallel.

In addition, a plurality of cardboard packagings 02 or pairs of cardboard packagings 02 can be simultaneously expanded next to each other, as seen in a direction in parallel to the pivoting axis or pivoting axes 13, to lying compartments and/or outer packagings 03 and subsequently be erected to standing compartments and/or outer packagings 03.

Figure 11:
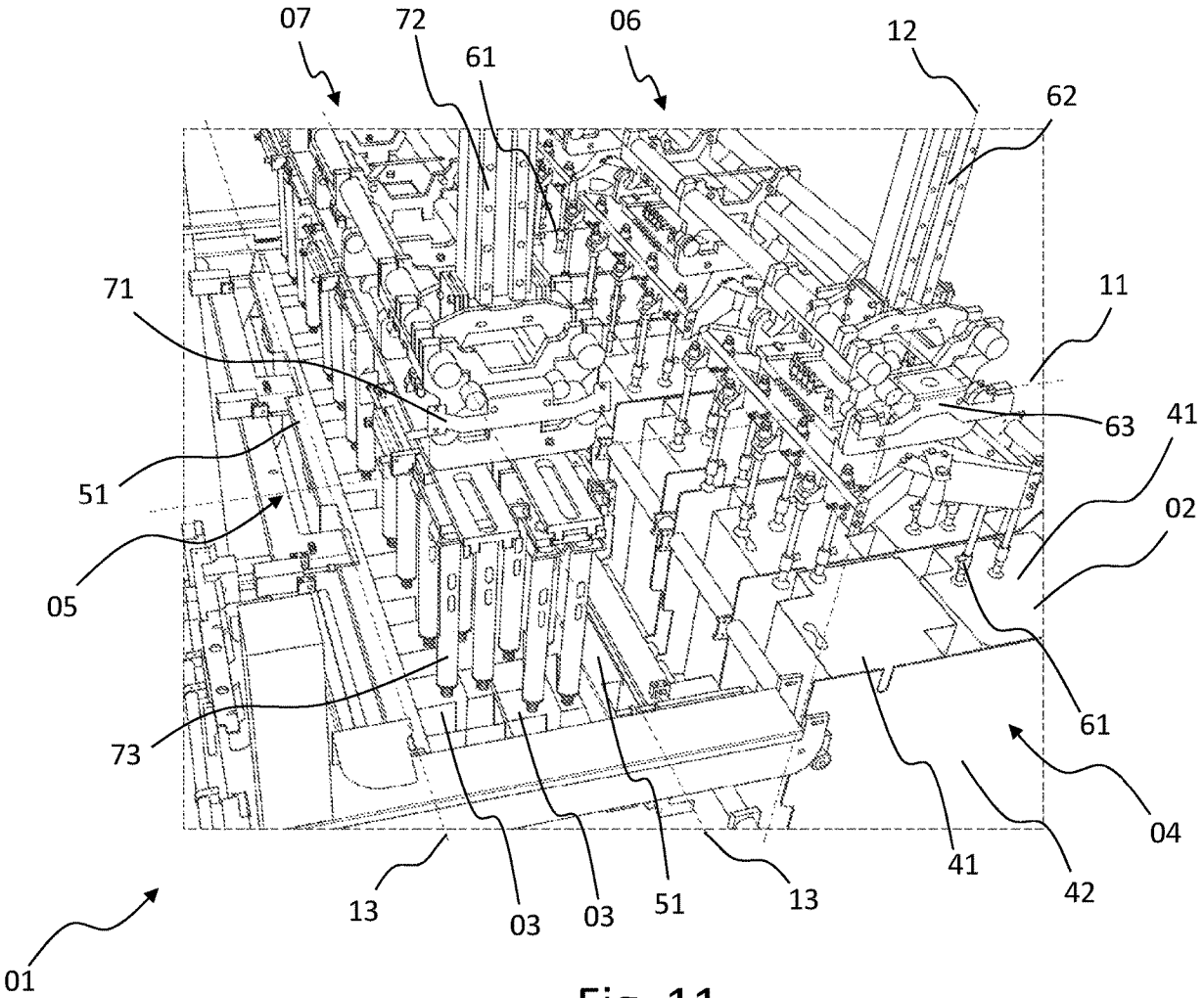
FIG. 11 shows a perspective view of a snapshot illustration temporally immediately following the snapshot illustration in FIG. 10.

While or after the expanded set of compartments and/or the outer packaging 03 is being or has been erected to a standing position, the compartments and/or outer packagings 03 can be moved relatively toward each other along and/or orthogonal to the horizontal axis 11 and thus be grouped in the instance of a simultaneous expanding and erecting of a plurality of cardboard packagings 02 to standing compartments and/or outer packagings 03, as is, for instance, illustrated in the sequence of the FIG. 10 and FIG. 11 using the example of a movement toward each other along the horizontal axis 11 of two groups of pairs of two cardboard packagings 02 expanded and erected next to each other as seen in the direction of the horizontal axis 11 to compartments and/or outer packagings 03.

It is obvious that the invention can be realized by an erecting of compartments and/or outer packagings 03 expanded from previously lying cardboard packagings 02, by continuing, even after releasing their cardboard packaging walls 22 previously assigned to the top flat sides 23 of the cardboard packagings 02, to hold the expanded compartments and/or outer packagings 03 at their cardboard packaging walls 22 previously assigned to the bottom flat sides 24 of the cardboard packagings 02, and subsequently rotating them by 90 degrees about a horizontal pivoting 13 axis of an erecting device 05 still holding the compartments and/or outer packagings 03 at their cardboard packaging walls 22 previously assigned to the bottom flat sides 24 of the cardboard packagings 02.

Both the apparatus 01 and the method can alternatively or additionally have individual or a combination of a plurality of features initially described in connection with the prior art and/or in one or more documents mentioned regarding the prior art.

Moreover, the apparatus 01 can alternatively or additionally have individual or a combination of a plurality of features previously described in connection with the method, as well as the method can alternatively or additionally have individual or a combination of a plurality of features previously described in connection with the apparatus 01.

Figure 16:
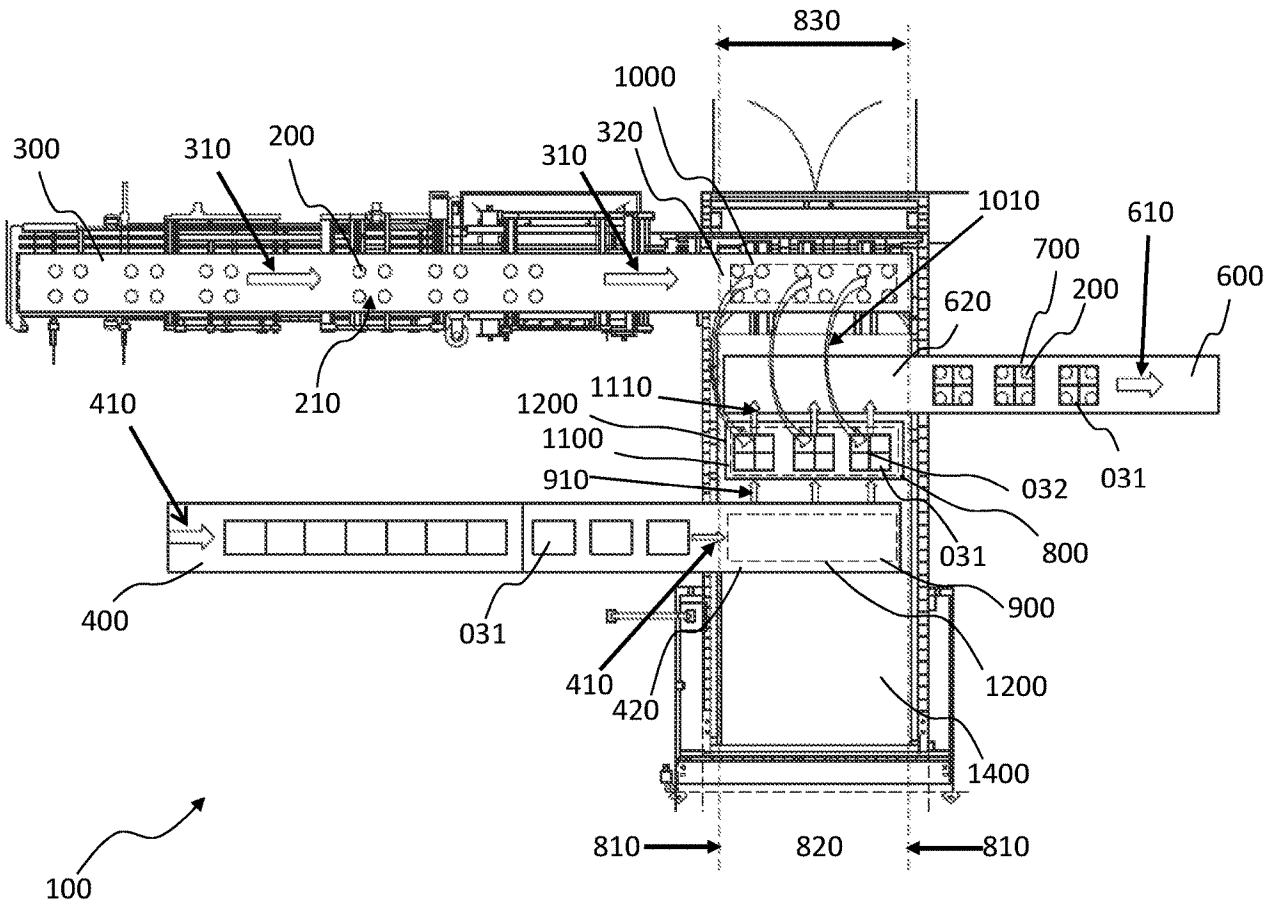
FIG. 16 shows a top view of a facility for handling articles.

A facility 100 for handling articles 200, which facility 100 is entirely or partly illustrated in FIG. 16, and to which facility compartments and/or outer packagings 03 can be supplied for further use, the compartments and/or outer packagings 03 having previously been expanded and erected by means of a previously described apparatus 01 according to a previously described method for expanding and erecting collapsed or folded cardboard packagings 02 to standing compartments and/or outer packagings 03, can be equipped with:

a first conveyor 300 for the supply of articles 200, a second conveyor 400 for the supply of outer packagings 031, a third conveyor 600 for the discharge of outer packagings 31 with articles 200 placed therein, termed for short, filled outer packagings 700, and a placing surface 800 arranged between the second conveyor 400 and the third conveyor 600, as well as a device 900, illustrated by a dashed line, for the transfer indicated by arrows 910 of supplied outer packagings 031 from the second conveyor 400 to the placing surface 800, a device 1000, illustrated by a dashed line, for the transferring indicated by arrows 1010 of articles 200 from the first conveyor 300 into outer packagings 031 having been transferred onto the placing surface 800, and a device 1100, illustrated by a dashed line, for the transfer indicated by arrows 1110 of filled 700, from the placing surface 800 onto the third conveyor 600.

The device 1000 for the transferring indicated by arrows 1010 of articles 200 first seizes the articles 200 staged by means of the first conveyor 300, then transfers the seized articles 200 from the first conveyor 300 to the placing surface 800 and, in the process, places the articles 200 having been seized and having been transferred from the first conveyor 300 to the placing surface 800 by it into the outer packagings 031 having been transferred onto the placing surface 800.

The facility 100 allows carrying out a method for handling articles 200, which method provides that articles 200 are placed into outer packagings 031 staged on a placing surface 800, which articles 200 are supplied in one or in a plurality of article flows of articles 200 lined up one after the other uninterruptedly and/or with gaps between them and/or grouped, which outer packagings 031 themselves in turn are supplied independently of the articles 200 in a transport direction indicated by arrows 410 and are transferred, as indicated by arrows 910, onto the placing surface 800 individually or groupwise transversely to the transport direction indicated by arrows 410 and, after the articles 200 have been placed therein, they are transferred from there, as indicated by arrows 1110, in turn individually or groupwise transversely to the transport direction indicated by arrows 410—now provided with articles 200 placed therein—in order to be subsequently discharged in the direction of the transport direction indicated by arrows 410 or opposite to it in parallel to the transport direction indicated by arrows 410 independently of the supply indicated by arrows 310 of articles 200, independently of the supply indicated by arrows 410 of outer packagings 031, and independently of the placing indicated by arrows 410 of articles 200 into the outer packagings 031.

Both the facility 100 and the method can be further developed as explained in the following.

The device 900 for the transfer indicated by arrows 910 of outer packagings 031 from the second conveyor 400 onto the placing surface 800 can comprise the device 1100 for the transfer indicated by arrows 1110 of filled outer packagings 700, from the placing surface 800 onto the third conveyor 600 or one or more parts of the device 1100 for the transfer indicated by arrows 1110 of filled outer packagings 700, from the placing surface 800 onto the third conveyor 600.

Alternatively, the device 900 for the transfer indicated by arrows 910 of outer packagings 031 from the second conveyor 400 onto the placing surface 800 can be completely or partly comprised by the device 1100 for the transfer indicated by arrows 111 of filled outer packagings 700, from the placing surface 800 onto the third conveyor 600.

The device 900 for transferring supplied outer packagings 031 from the second conveyor 400 to the placing surface 800 and the device 1100 for transferring filled outer packagings 700 from the placing surface 800 onto the third conveyor 600 thus each in themselves or together form at least one transfer device 1200 that is formed and operatable independently of the device 1000 for transferring articles 200 from the first conveyor 300 into outer packagings 031 having been transferred onto the placing surface 800.

The placing surface 800 in connection with the at least one transfer device 1200 that is independent of the device 1000 for transferring articles 200 from the first conveyor 300 into outer packagings 031 having been transferred onto the placing surface 800 results in an increase in performance with regard to the pacing that is achievable based on an apparatus without placing surface 800. The higher pacing is achieved, because, by means of the placing surface 800 in connection with the at least one transfer device 1200 that is independent of the device 1000 for transferring articles 200, articles 200 supplied by means of the first conveyor 300 can be seized by the device 1000 for transferring articles 200 in a first cycle, and the device 1000 for transferring articles 200 can begin with transferring the seized articles 200 by starting a movement of the seized articles 200 from the first conveyor 300 to the placing surface 800 while outer packagings 031 that are still empty are simultaneously transferred, for instance, by pushing off or over, from the second conveyor 400 to the placing surface 800 and filled outer packagings 700 are transferred by pushing off or over from the placing surface 800 onto the third conveyor 600, and in a second cycle new, empty outer packagings 031 can be supplied by means of the second conveyor 400 and filled outer packagings 700 can simultaneously be discharged from the third conveyor 600, while the transferring of the articles 200 having been seized in the first cycle is simultaneously completed by placing articles 200 by means of the device 1000 for transferring articles 200 into the outer packagings 031 staged on the placing surface 800.

In this context, the transferring of the articles 200 seized in the first cycle is concluded by placing the articles 200 having been seized by the device 1000 for transferring articles 200 into the empty outer packagings 031 having been transferred by pushing off or over onto the placing surface 800 in the first cycle, and by a return of the device 1000 for transferring articles 200 from the placing surface 800 to the first conveyor 300 at least being started, in order to again seize and, in a repetition of the first cycle, transfer articles 200 supplied from the first conveyor 300.

The transfer indicated by arrows 910 from the second conveyor 400 to the placing surface 800 can be carried out by pushing over supplied outer packagings 031.

The transferring as indicated by arrows 1010 can be carried out by gripping the articles 200, pushing the gripped articles over the edge of the first conveyor 300 or by slightly lifting the gripped articles from the first conveyor 300 as well as lowering them into the outer packagings 031 staged on the placing surface 800.

The transfer indicated by arrows 1110 from the placing surface 800 to the third conveyor 600 can be carried out by pushing over filled outer packagings 700.

Preferentially, at least the second conveyor 400 and the third conveyor 600 are arranged in parallel to each other along the placing surface 800, at least in the area of their portions 320, 420, 620 abutting on the placing surface 800 or, in other words, the second conveyor 400 and the third conveyor 600 run in parallel to each other at least in the area of their portions 320, 420, 620 abutting on the placing surface 800.

In addition, the first conveyor 300 can run in parallel to the second conveyor 400 and in parallel to the third conveyor 600.

In the arrangement in parallel to each other, the transport directions indicated by arrows 310, 410, 610 of the conveyors 300, 400, 600 run in parallel to each other at least in the area 820 located between the arrows 810 of their portions 320, 420, 620 abutting on the placing surface 800, or, as the case may be, of their portions 320, 420, 620 overlapping each other in the area of the placing surface 800. This applies to transport directions of all conveyors 300, 400, 600 running in the same direction as well as to transport directions of at least two conveyors 300, 400, 600 running in opposite directions.

The parallely arranged portions 320, 420, 620 of the conveyors 300, 400, 600 can overlap one another by a distance indicated by the double arrow 830 of the length of at least two, preferably at least three outer packagings 031 staged on the placing surface 800.

In this way, two or more outer packagings 031 can be simultaneously transferred from the second conveyor 400 onto the placing surface 800 and two or more filled outer packagings 700 can be simultaneously transferred from the placing surface 800 to the third conveyor 600, and likewise articles 200 can be simultaneously placed into the plurality of outer packagings 031 that are thus staged on the placing surface 800. The pacing can thus be further increased.

The direction of the transfer of outer packagings 031, termed for short transfer direction, indicated by arrows 910, and being carried out by the device 900 for transferring empty outer packagings 031 from the second conveyor 400 to the placing surface 800, runs, in a horizontal direction, preferably transversely, preferentially orthogonal to the transport direction indicated by arrows 410 of the second conveyor 400.

The direction of the transfer of filled outer packagings 700, which direction is termed for short transfer direction, is indicated by arrows 1110, and is being carried out by the device 1100 for transferring filled outer packagings 700, from the placing surface 800 to the third conveyor 600, runs, in a horizontal direction, preferably transversely, preferentially orthogonal to the transport direction indicated by the arrow 610 of the third conveyor 600.

In the transfer from the second conveyor 400 to the placing surface 800 and in the transfer from the placing surface 800 to the third conveyor 600, the transfer direction indicated by arrows 910 and by arrows 1110 of the device or the devices 900 for transferring preferably both the empty outer packagings 031 and the filled outer packagings 700, thus preferentially runs, in a horizontal direction, preferably transversely, preferentially orthogonal to the transport directions indicated by arrows 410 and 610 of both the second conveyor 400 and the third conveyor 600.

By the transversal and preferably orthogonal horizontal transfer direction indicated by arrows 910 and by arrows 1110 in relation to the transport directions indicated by arrows 410 and 610 of the second conveyor 400 and the third conveyor 600, one or more empty outer packagings 031 as well as one or more filled outer packagings 700, can be respectively simultaneously transferred from the second conveyor 400 to the placing surface 800 as well as from the placing surface 800 to the third conveyor 600, whereby articles 200 can be simultaneously placed into a plurality of outer packagings 031 that have been put down on the placing surface 800. The pacing can thus be significantly increased.

For instance, the device 900 for transferring outer packagings 031 from the second conveyor 400 onto the placing surface 800 and/or the device 1100 for transferring filled outer packagings 700, from the placing surface 800 onto the third conveyor 600 can comprise at least one slider.

The second conveyor 400 and the third conveyor 600 as well as the placing surface 800 are preferentially located on a common, first level.

The first conveyor 300 is preferably located on a higher, second level.

A vertical stroke of the device 1000 for transferring articles 200, which vertical stroke is necessary for placing articles 200 into outer packagings 031, can thus be reduced to the essential, whereby the pacing can be further increased.

The second level can be located above the first level by at least the height of an outer packaging 031, which is initially open and to be closed after placing the articles 300 therein, as the case may be.

In the instance of flaps for closing that protrude to the top from an outer packaging 031 designed as a closable cardboard packaging, the second level is preferentially located accordingly higher, by the height of the flaps protruding above the first level, than in the instance of the outer packagings 031 being closed, for instance, with a separately provided lid.

The closing of the filled outer packagings 700, can be carried out while still on the placing surface 800, for instance, together with or subsequent to placing the articles 200 into the outer packagings 031, or in a separate treatment step, for instance, subsequent to or in the further course of the third conveyor 600 of the facility 100 for handling articles 200.

For instance, the filled outer packagings 700, can be closed with lids in the further course of the third conveyor 600.

Prior to placing the articles 200 into outer packagings 031 having been transferred onto the placing surface 800, compartments 032, also termed so-called baskets, can be inserted into the outer packagings 031, which compartments 032 assign fixed positions to the articles 200 within the outer packagings 031 and thus protect them, during the further transport of the outer packagings 031 with articles 200 placed therein until the articles 200 are withdrawn and consumed, from colliding with each other and rubbing against each other, which otherwise would lead to a negative impression of the quality by scuffing, for instance, of information applied onto the articles 200 in the form of labels, for example, and/or by the articles 200 damaging each other.

The compartments 032 can already have been or be inserted into the outer packagings 031 prior to the transfer of the outer packagings 031 to the placing surface 800, or the compartments 032 can be inserted into the outer packagings 031 prior to or together with or after the articles 200 being placed into the outer packagings 031.

The compartments 032 can be staged, for instance, by a separate device 1400, which can simultaneously erect the compartments 032, for instance.

The subsequent introduction of compartments 032, in particular with lightweight articles 200 that are shiftable with little effort within the outer packagings 031, has the advantage of a simplified placing of the articles 200 in the outer packagings 031, along with a reduced controlling effort for the device 1000 for transferring the articles 202, because articles 200 with a shape, for example, tapering conically or in a similar manner toward their oppositely located contact surfaces, such as beverage bottles with a bottle neck widening at least sectionwise from the top downward, can be horizontally shifted within the outer packagings 031 by the compartments 032 when these are inserted.

The compartments 032 can be introduced into the outer packagings 031, for instance, while still on the second conveyor 400, or they can be introduced into the outer packagings 031, for instance, already together with or subsequent to erecting these, or they can already be integrated into an according cardboard packaging, wherein the compartments 032 unfold within the outer packaging 031 with the cardboard packaging being erected.

In connection with introducing compartments 032 prior to or after placing articles 200 into the outer packagings 031, a separate introduction surface can alternatively be provided between the second conveyor 400 and the placing surface 800 in the instance of the introduction of compartments 032 prior to placing the articles 200, or between the placing surface 800 and the third conveyor 600 in the instance of the introduction of compartments 032 after placing the articles 200.

In this context, an additional device can be provided for the transfer of outer packagings 031 provided with compartments 032 from the introduction surface to the placing surface 800 or from the placing surface 800 to the introduction surface, which additional device can also be part of a transfer device 1200 or be comprised by it.

In the further course of the third conveyor 600 of the facility 100 for handling articles 200, a stacking station can be provided, where, for instance, filled outer packaging items 700 designed as closed outer packagings 031, with articles 200 placed therein, are grouped into stack layers and stacked onto a stack, which is then discharged in order to make room for stacking up a new stack after reaching a specified stacking height according to a specified number of stack layers stacked on top of each other at the stacking station.

The articles 200 supplied by means of the first conveyor 300 are preferentially already sorted into article groups 210 to be respectively placed into an outer packaging 031. The articles 200 supplied by means of the first conveyor 300 can abut on each other or they can be supplied lined up one after the other with gaps between them. The articles 200 supplied by means of the first conveyor 300 can be supplied in one row or in a plurality of rows running in parallel. For this purpose, the articles 200 can be transferred to the first conveyor 300 via a suitable infeed, and be guided in one or in a plurality of lanes oriented in parallel to each other after the transfer to the first conveyor 300.

The articles 200 supplied by means of the first conveyor 300 accordingly form a single- or multiple-row article flow of articles 200 lined up one after the other uninterruptedly and/or with gaps between them.

Before the articles 200 are subsequently placed into the outer packagings 031 by means of the facility 100 for handling articles 200, the said articles 200 can have been previously treated along an infeed to the first conveyor 300, for instance, by producing a container and/or cleaning an outer and/or inner surface and/or cooling and/or filling and/or closing, in order to name only a few examples of treating articles 200 without claim to completeness of the list, and/or the articles 200 can have been previously handled along an infeed to the first conveyor 300, for instance, by separating a number of articles 200 from one or more article flows of articles being transported immediately following each other and/or grouping a number of articles 200 into article groups 210 and/or compiling and assembling a number of articles 200 into bundles, in order to name only a few examples of handling articles 200 without claim to completeness.

The conveyors 300, 400, 600 preferentially comprise at least one horizontal conveyor device, such as, for instance, a belt conveyor and/or a roller conveyor.

The outer packagings 031 can preferentially be cardboard packagings, for instance, in the form of cardboard boxes with or without compartments 032 arranged or arrangeable therein for separating and/or keeping apart individual articles 200 from each other.

It is obvious that a facility 100 for handling articles 200, to which facility 100 compartments and/or outer packagings 03 can be supplied for further use, the compartments and/or outer packagings 03 having previously been expanded and erected by means of a previously described apparatus 01 according to a previously described method for expanding and erecting collapsed or folded cardboard packagings 02 to standing compartments and/or outer packagings 03, can be equipped with:

a first conveyor 300 supplying articles 200 in a first transport direction indicated by arrows 310, a second conveyor 400 supplying outer packagings 031 in a second transport direction indicated by arrows 410 and preferentially directed in parallel to and running in the same direction as or opposite to the first transport direction indicated by arrows 310, a third conveyor 600 discharging filled outer packagings 700, in a third transport direction indicated by an arrow 610 and preferentially directed in parallel to and running in the same direction as or opposite to the first transport direction indicated by arrows 310 and to the second transport direction indicated by arrows 410, a placing surface 800 arranged between the second conveyor 400 and the third conveyor 600, a device 900 for the transfer indicated by arrows 910 of supplied outer packagings 031 from the second conveyor 400 to the placing surface 800, a device for the transferring indicated by arrows 1010 of articles 200 from the first conveyor 300 into outer packagings 031 having been transferred onto the placing surface 08, and a device 1100 for the transfer indicated by arrows 1110 of outer packagings 700 with articles 200 placed therein, also termed outer packagings items 700, from the placing surface 800 onto the third conveyor 600, wherein the device 900 for the transfer of supplied outer packagings 031 from the second conveyor 400 to the placing surface 800 and the device 1100 for the transfer of filled outer packagings 700, from the placing surface 800 onto the third conveyor 600 can be combined in one common transfer device 1200.

The described facility 100 can be part of an apparatus 01 or comprise an apparatus 01 or be comprised by an apparatus 01.

The invention has been described with reference to a preferred embodiment. Those skilled in the art will appreciate that numerous changes and modifications can be made to the preferred embodiments of the invention and that such changes and modifications can be made without departing from the spirit of the invention. It is, therefore, intended that the appended claims cover all such equivalent variations as fall within the true spirit and scope of the invention.

LIST OF REFERENCE CHARACTERS

01 Apparatus
02 Cardboard packaging
03 Compartments and/or outer packaging
04 Cardboard packaging supply
05 Erecting device
06 Gripping device
07 Transfer device
11 Horizontal axis
12 Vertical axis
13 Pivoting axis
14 Pivoting axis
21 Bending edges
22 Cardboard packaging wall
23 Top flat side
24 Bottom flat side
31 Access opening
41 Stack
42 Magazine
43 Magazine partition wall
44 First stack
45 Second stack
51 Carrier
52 Tool (of the erecting device)
53 Suction cup
54 Device
55 Holding apparatus
56 Actuator
57 Bar
58 Cantilever arm
59 Pin
61 Tool (of the gripping device)
62 Manipulator
63 Manipulator head
64 Suction cup
71 Head
72 Transfer device manipulator
73 Tool
100 Facility
200 Article
300 First conveyor
400 Second conveyor
031 Outer packaging
600 Third conveyor

700 Filled outer packagings (outer packaging with articles placed therein)
800 Placing surface
900 Device for transfer
1000 Device for transferring
1100 Device for transfer
1200 Transfer device
032 Compartments
1400 Device
210 Article group
310 Arrow
320 Portion
410 Arrow
420 Portion
610 Arrow
620 Portion
810 Arrow
820 Area
830 Double arrow
910 Arrow
1010 Arrow
1110 Arrow

The invention claimed is:

1. An apparatus (01) for expanding and erecting collapsed or folded cardboard packagings (02) to standing compartments and/or outer packagings (03), comprising:

a cardboard packaging supply (04) comprising at least one stack (41) of flatly collapsed cardboard packagings (02) arranged lying on top of each other, an erecting device (05) arranged next to the cardboard packaging supply (04) as seen in the direction of a horizontal axis (11), and a gripping device (06) for the simultaneous seizing one topmost cardboard packaging (02) from each stack (41) of the cardboard packaging supply (04), wherein:

the cardboard packagings (02) comprise a plurality of cardboard packaging walls (22) interconnected with each other, one forming a top flat side (23) and one forming a bottom flat side (24) of a flatly collapsed cardboard packaging (02), the gripping device (06) has at least one tool (61) for holding the top flat side (23) of the cardboard packaging wall (22), the gripping device (06) has at least one manipulator (62) with a manipulator head (63) that is at least movable along a horizontal axis (11), wherein the at least one tool (61) is arranged at the manipulator head (63) so that the at least one tool (61) is movable at least horizontally between the cardboard packaging supply (04) and the erecting device (05), the erecting device (05) has at least one carrier (51) that is rotatable about a horizontal pivoting axis (13) from a horizontal position to a vertical position and vice versa, the erecting device (05) has at least one tool (52), arranged at its at least one carrier (51), for each cardboard packaging (02) that is simultaneously seizable by the gripping device (06), the at least one tool (52), in its horizontal position, seizes each cardboard packaging (02), at its bottom flat side (24), each cardboard packaging (02) is expanded to a set of compartments and/or to an outer packaging (03) by an increase of the distance between the at least one tool (61) of the gripping device (06) and the at least one tool (52) of the erecting device (05) along a vertical axis (12), and the at least one tool (52) holds each cardboard packaging (02) at least until the at least one carrier (51) has rotated about the horizontal pivoting axis (13) from its horizontal position into its vertical position so that access openings through which articles can be introduced into the expanded compartments and/or outer packaging (03) are in a vertical plane.

2. The apparatus as recited in claim 1 wherein the erecting device (05) has at least one carrier (51) that is rotatable about a horizontal pivoting axis (13) that is orthogonal to the horizontal axis (11) and orthogonal to the vertical axis (12).

3. The apparatus as recited in claim 1 wherein the manipulator head (63) is movable along the vertical axis (12).

4. The apparatus as recited in claim 3 wherein an increase of the distance between the at least one tool (61) of the gripping device (06) and the at least one tool (52) of the erecting device (05) is carried out by a vertical lifting of the at least one tool (61) of the gripping device (06) arranged at the manipulator head (63).

5. The apparatus as recited in claim 1 wherein the erecting device (05) is vertically movable.

6. The apparatus as recited in claim 5 wherein an increase of the distance between the at least one tool (61) of the gripping device (06) tools (61) and the at least one tool (52) of the erecting device (05) is carried out by a vertical lowering of the at least one tool (52) of the erecting device (05).

7. The apparatus as recited in claim 1 wherein the cardboard packaging supply (04) comprises an uprightly standing magazine (42) accommodating one or more stacks (41) wherein the magazine (42) is accessible from its top side.

8. The apparatus as recited in claim 1 wherein the cardboard packaging supply (04) has two or more stacks (41) of cardboard packagings (02) wherein the stacks (41) are adjacent to each other as seen in a horizontal direction parallel to the horizontal pivoting axis (13), and wherein the gripping device (06) and the erecting device (05) each have a plurality of tools (61, 52), which are arranged next to each other and parallel to the horizontal pivoting axis (13), and wherein the plurality of tools (61) of the gripping device (06) and the plurality of tools (52) of the erecting device (05) cooperate with each other to simultaneously expand a set of cardboard packagings (02).

9. The apparatus as recited in claim 1 wherein the erecting device (05) has at least two carriers (51) with at least one tool wherein the carriers (51) are each rotatable about their own pivoting axes (13), wherein:

the pivoting axes (13) of the carriers (51) are parallel to each other, and the gripping device (06) has a plurality of tools (61) that are arranged next to each other and orthogonal to the pivoting axes (13).

10. The apparatus as recited in claim 9 wherein the erecting device (05) has at least two carriers (51), which are respectively rotatable about their own horizontal pivoting axes (13) in opposite directions from a horizontal position to a vertical position and vice versa, wherein the cardboard packagings (02) of a first stack (44) of the two stacks (41), are stacked, as seen in relation to a mirror axis running in parallel to the horizontal pivoting axes (13) between the two stacks (41), mirror-invertedly with respect to cardboard packagings (02) of a second stack (45) of the two stacks (41).

11. The apparatus as recited in claim 9 wherein the at least two carriers (51) of the erecting device (05) are movable in a horizontal direction.

12. The apparatus as recited in claim 1, wherein:

the gripping device (06) has at least one tool (61) for each simultaneously seized cardboard packaging (02), and has at least one downwardly directed suction cup (64), which, in combination with a vacuum, is able to hold a cardboard packaging (02) at its top flat side (23), or the at least one tool (52) of the erecting device is one or more suction cups (53).

13. The apparatus as recited in claim 1 further comprising a control device that, at least:

controls the at least one manipulator (62) of the gripping device (06) such that it carries out a cyclical movement path, in the course of which the manipulator head (63) traverses in parallel to the horizontal axis (11) from above the cardboard packaging supply (04) over the erecting device (05) and back again, controls the gripping device (06) and/or the erecting device (05) such that each carry out a recurring movement path relative to the other as seen in direction of the vertical axis (12), in the course of which movement path, the distance between the gripping device (06) tools (61) and the erecting device (05) tools (52) is increased at least so far that a cardboard packaging (02) being held between the tools (61, 52) is expanded to a set of compartments and/or to an outer packaging (03), and in the further course of which movement path the vertical distance between the tools (61, 52) is again reduced to at least a thickness dimension measured normal to the top and bottom flat sides (23, 24) of a lying, flatly collapsed cardboard packaging (02), controls the at least one tool (61) of the gripping device (06) such that, when it is located above the at least one stack (41) of the cardboard packaging supply (04), it seizes the top flat side (23) of a cardboard packaging (02) lying topmost on at least one stack (41) of the cardboard packaging supply (04) and holds it until it is located above the erecting device (05) and the distance between the gripping device (06) tools (61) and the erecting device (05) tools (52) has been increased at least so far that the cardboard packaging (02) is expanded to a set of compartments and/or to an outer packaging (03) in the course of the recurring movement path of the gripping device (06) and the erecting device (05), controls the at least one carrier (51) of the erecting device (05) such that it carries out a cyclical rotating movement path, in the course of which it is rotated about its horizontal pivoting axis by 90 degrees from its horizontal position into its vertical position and back again, wherein the carrier (51) takes up a horizontal position at the latest when the at least one manipulator head (63) is located, during its course of movement along the horizontal axis (11), above the erecting device (05), and maintains the horizontal position until the distance between the gripping device (06) tools (61) and the erecting device (05) tools (52) has been increased at least so far that a cardboard packaging (02) is expanded to a set of compartments and/or to an outer packaging (03) in the course of the recurring movement path of the gripping device (06) and the erecting device (05), in order to hereafter take up a vertical position by swinging down and/or rotating about its horizontal pivoting axis (13), and controls the at least one tool (52) of the erecting device (05) such that, as soon as the manipulator head (63) is located above the erecting device (05), the tool (52) seizes the bottom flat side (24) of the at least one cardboard packaging (02) being held by the at least one tool (61) of the gripping device (06) and holds it at least until the cardboard packaging (02), which was initially expanded to a set of compartments and/or an outer packaging (03), has been erected to a standing position and is available for its further use by swinging down and/or rotating the at least one carrier (51) of the erecting device (05) by 90 degrees about its horizontal pivoting axis (13) from its horizontal position to its vertical position.

14. The apparatus as recited in claim 1 wherein the surface of the cardboard packaging supply (04) formed by the topmost cardboard packaging (02) of the at least one stack (41) is located at a level that is higher, by at least the height of a lying, expanded set of compartments and/or of a lying outer packaging (03), than a level of the erecting device (05) formed by the at least one tool (52) of the erecting device (05) in the horizontal position of its at least one carrier (51) during the seizing of a cardboard packaging wall (22) of the bottom flat side (24) of a cardboard packaging (02).

15. A method for expanding and erecting collapsed or folded cardboard packagings (02) to standing compartments and/or outer packagings (03), comprising:

removing a topmost cardboard packaging (02) at a cardboard packaging wall (22) of its top flat side (23), from a stack (41) of flatly collapsed cardboard packagings (02) arranged on top of each other of a supply (04) of cardboard packagings (02), while holding the cardboard packaging (02) at a cardboard packaging wall (22) of its bottom flat side (24) from below, increasing the vertical distance between the top flat side (23) and the bottom flat side (24), by oppositely pulling on the cardboard packaging walls until the cardboard packaging (02) has been expanded to a set of compartments and/or to a lying outer packaging (03), releasing the expanded cardboard packaging (02) at its top flat side (23), and rotating the expanded cardboard packaging (02) about a horizontal pivoting axis (13) so that access openings through which articles can be introduced into the compartments and/or outer packaging (03) are in a vertical plane and then releasing the expanded and now erected cardboard packaging (02) at its bottom flat side (24).

* * * * *